US008515103B2

(12) United States Patent
Mei et al.

(10) Patent No.: US 8,515,103 B2
(45) Date of Patent: Aug. 20, 2013

(54) 3D STEREO EARPHONE WITH MULTIPLE SPEAKERS

(75) Inventors: David Mei, Forest Hills, NY (US); Jin Xia Bao, Forest Hills, NY (US)

(73) Assignee: Cyber Group USA Inc., Forest Hills, NY (US)

( * ) Notice: Subject to any disclaimer, the term of this patent is extended or adjusted under 35 U.S.C. 154(b) by 353 days.

(21) Appl. No.: 12/927,703

(22) Filed: Nov. 22, 2010

(65) Prior Publication Data

US 2011/0158440 A1 Jun. 30, 2011

Related U.S. Application Data

(60) Provisional application No. 61/284,940, filed on Dec. 29, 2009.

(51) Int. Cl.
*H04R 5/02* (2006.01)
*H04R 1/10* (2006.01)

(52) U.S. Cl.
USPC ..... 381/309; 381/74; 381/310

(58) Field of Classification Search
USPC ..... 381/74, 309, 310, 370, 374, 379; 455/575.2–575.4
See application file for complete search history.

(56) References Cited

U.S. PATENT DOCUMENTS

| | | | | |
|---|---|---|---|---|
| 3,751,608 | A | 8/1973 | Weingartner | |
| 4,453,050 | A | 6/1984 | Enokido | |
| 4,783,822 | A | 11/1988 | Toole et al. | |
| 6,097,827 | A | 8/2000 | Yang | |
| 6,369,952 | B1 | 4/2002 | Rallison et al. | |
| 6,427,018 | B1 | 7/2002 | Keliiliki | |
| 6,434,250 | B1 | 8/2002 | Tsuhako | |
| 6,772,853 | B2 | 8/2004 | Yang | |
| 7,006,649 | B2 | 2/2006 | Natvig | |
| 7,356,156 | B2 | 4/2008 | Ruegg | |
| 7,697,709 | B2 * | 4/2010 | Mei et al. | 381/379 |
| 8,000,490 | B2 * | 8/2011 | Yang | 381/371 |
| 8,116,502 | B2 * | 2/2012 | Saggio et al. | 381/380 |
| 2004/0213428 | A1 | 10/2004 | Lenhard-Backhaus | |
| 2009/0220113 | A1 * | 9/2009 | Tiscareno | 381/309 |
| 2009/0232342 | A1 * | 9/2009 | Oliveira et al. | 381/382 |
| 2009/0279729 | A1 | 11/2009 | Huang | |
| 2010/0046783 | A1 | 2/2010 | Huang | |

* cited by examiner

*Primary Examiner* — Vivian Chin
*Assistant Examiner* — Ammar Hamid
(74) *Attorney, Agent, or Firm* — Collard & Roe, P.C.

(57) ABSTRACT

An earphone produces a three-dimensional stereo sound effect. The earphone has an ear cup with a front portion, a back portion, a front sound effect unit disposed in the front portion, a front sound resonator disposed in the front portion, a back sound resonator disposed in the back portion, and a back sound effect disposed in the back portion. A front speaker is disposed in the front portion of the ear cup. A back speaker is disposed in the back portion of the ear cup. A sound controller is disposed in the ear cup. A sound output unit is connected with the ear cup. The front speaker and the back speaker work together to create stereo sound in a first dimension and in a second dimension. One of the front speaker and the back speaker creates stereo sound in a third dimension.

24 Claims, 21 Drawing Sheets

3D STEREO EARPHONE WITH MULTIPLE SPEAKERS

CROSS REFERENCE TO RELATED APPLICATIONS

This application claims priority under 35 U.S.C. §119(e)(i) and the benefit of U.S. Provisional Application Ser. No. 61/284,940, entitled "Sound direction/stereo 3D adjustable earphone" filed Dec. 29, 2009, which is incorporated in its entirety by reference herein.

BACKGROUND OF THE INVENTION

1. Field of the Invention

The present invention is an improvement on U.S. Pat. No. 7,697,709 and relates to an earphone for use with audio systems and communication systems and more particularly to an earphone with multiple speakers (sound drivers) structured in a front-and-back straight arrangement at the same axis line or different axes lines, or structured in a front-and-back angled arrangement, to achieve three-dimensional stereo sound effects with bass/middle/high frequencies of sound and to achieve three-dimensional direction-adjustable stereo sound for hearing safety and wearing comfort.

2. The Prior Art

There are more and more types of earphones coming into the market, especially for many multi-functional MP3 players, MP4 players, and cell phones such as, Apple's iPod®, iPhone®, iPad®, etc. A big challenging issue in front of earphone developers and makers is that earphone size is demanded to become smaller and smaller and more focused on an In-Ear style for convenient and comfortable wearing, and at the same time, earphone sound quality is demanded to become higher and higher to match a full-scale sound in bass (low), middle, and high frequencies, and further, a real-stage-like 3D stereo sound space and effect. One speaker at a certain small size has not enough sound power to achieve full-scale sound quality. So-called stereo sound for small earphones, especially In-Ear earphones, only has a two-dimensional (X-Y) sound range, i.e. 2D sound with bass/middle/high frequencies. The three sound frequencies of bass/middle/high are only for different sound volumes and contents. In that case, the so-called stereo sound is for three frequencies of sound only, not for a real stereo sound, i.e. not for a three-dimensional (3D) sound space or effect. Due to the space limit, there is no third dimensional (Z) depth sound with those small earphones. Therefore, those small earphones are not able to achieve X-Y-Z three-dimensional stereo sound space/effect with bass/middle/high frequencies of sound. Of course, if there is a big earphone or headphone having a big space, multiple speakers can be put anywhere to have a fully arranged sound quality. Obviously, the dilemma is not only how to put more multiple speakers (multiple sound drivers) into a small earphone having a very limited size, but also how to arrange those multiple speakers for better 3D stereo sound effects.

As prior art, there are many types of small earphones having multiple speakers, i.e. multiple sound drivers, in the market already. The arrangements and structures of those multiple speakers still follow the traditional speaker arrangement: a parallel horizontal arrangement. The reason for arranging the speakers in a parallel horizontal arrangement is that a traditional sound study and research system needs to set all sound sources to be working at the same parallel level point within a certain sound environment, especially for one small earphone container containing multiple sound sources, i.e. multiple sound drivers. Even with those multiple sound drivers, the three sound frequencies of bass/middle/high are only for different sound volumes and contents, maybe in X-Y two-dimensional sound space.

The problem of those multiple speakers in the parallel position is that they are not able to develop a real stereo sound, especially for bass (low) frequency in a deep sense, because the area of the multiple parallel speakers is too small to have a good resonance depth space and effect. Those small earphones with multiple speakers are still only with a sound range in the X-Y axes - - - 2D sound with bass/middle/high frequencies, and not for a real stereo sound of 3D sound space or effect.

Apple In-Ear Headphones with Remote and Microphone have two drivers on each earpiece, one driver as a woofer and another one as a tweeter. Those two drivers are arranged parallel to one another for rich and detailed sound reproduction and bass response. Because the two sound drivers are arranged in parallel in a very small space, the bass response is not strong and is not rich enough and lacks deep sound space and effect in a third dimension (Z).

Shure provides two kinds of In-Ear earphones with multiple sound drivers, one with dual sound drivers and another one with triple sound drivers. Dual High-Definition Microdrivers for the item number SE425 are a tweeter and woofer for accurate and balanced sound in parallel structure. Triple High-Definition Microdrivers for the item number SE535 are one sound driver as a tweeter and dual sound drivers as woofers arranged in a parallel structure for spacious sound and rich bass. As for the other known earphones having multiple speakers, because the dual or triple drivers are arranged in parallel in a very small space, the bass response is not strong, is not rich enough, and lacks deep sound space and effect in a third dimension (Z).

M-Audio has a very famous In-Ear earphone, IE-40 acclaimed Ultimate Ears Technology, with three separate high-definition precision-balanced armature drivers for high, mid and low frequencies of sound. Ultimate Ears Technology is with a patented Dual-Bore Design to send a wider sound through separate acoustic canals for high and low channels, which allows the sound to be directly sent and mixed naturally in a user's ear. In other words, the Dual-Bore Design mixes all frequencies in a user's ear through a high frequency canal and a mid-bass canal into a user's ear, but does not mix all frequencies inside the earphone before delivering them into a user's ear. The dual drivers or triple drivers are arranged in a parallel structure. Also, the high and low canals are arranged in a parallel structure. Obviously, the bass response of IE-40 is not strong and is not rich enough because there is no resonance area inside IE-40 for bass deep response. Ultimate Ears of Logitich uses the same technology for its various earphones with multiple drivers.

There are two U.S. patent applications related to dual-frequency coaxial earphones: U.S. Patent Application No. 2009/0279729 A1 and U.S. Patent Application Publication No. 2010/0046783 A1. Those two applications discuss a shared magnet to work with dual frequency voice coils, one for low-frequency and another one for high-frequency. Those voice coils of low and high frequency speakers shared coaxially with one center magnet are not able to be independently and separately arranged or structured for stereo sound outputs. There is no deep space with those dual-frequency coaxial earphones.

An In-Ear earphone is a very particular earphone design that requires a special closed/isolated sound environment from the sound sources, to the sound effect area and resonance area, and to the output unit into a user's ear tunnels directly and closely as much as possible. There are three basic considerations for In-Ear earphones: small size, real stereo sound quality with bass/middle/high sound frequencies, and wearing/hearing comfort into a user's ear tunnels. Those considerations have to be achieved within a very small, closed, and isolated sound space and output environment and structure, which usually is an ear cup/shell and an In-Ear mushroom head.

Through studying the above five kinds of earphone products, there are many problems and issues still needed to be solved. The first problem or issue is that when the In-Ear earphones are built smaller and smaller, the sound is highly demanded to have a real stereo sound quality in three dimensions (X-Y-Z). Within the very limited small space, the In Ear earphone needs a better structure, better sound system, better arrangement of multiple speakers and related resonance sound effect area for high quality X-Y-Z dimensional 3D sound achievement. The conventional stereo sound in two dimensions (X-Y) is not enough to satisfy people's needs, and actually is not a real stereo. All of the above five kinds of earphones have no third-dimensional depth sound quality (Z axis) because of their parallelized structures - - - no X-Y-Z 3D stereo sound space and effect.

The second problem is that all old and current earphones, including the above five kinds of earphones, are preset for sound direction and channel stereo effects and usually focus on the back head center point of the earphone user. When an earphone user uses the earphone too long, his back center point of hearing nerve may be damaged.

The third problem is that the sound effects and sound output directions are always separate in all earphone products, especially for In-Ear earphones. People need a new product with hearing safety and sound high quality worked together at the same time for life enjoyment including music and health.

Generally speaking, with known earphones there is no way to have the earphone sound quality with X-Y-Z 3D stereo sound effects and 3D sound directions. Those earphones including the above five kinds of earphones have so-called stereo sound effects with no third-dimensional (Z) depth sound quality and/or have sound direction with no third dimensional (Z) depth adjustment.

Therefore, in order to solve the foregoing problems and drawbacks, a need exists for an earphone, especially for an In-Ear earphone, that has 3D stereo sound effects and outputs in X-Y-Z three dimensions, just like real-stage sound effects. Another need exists for an earphone, especially for an In-Ear earphone, that has 3D sound direction adjustments in X-Y-Z three dimensions for hearing safety. A third need exists for an earphone, especially for an In-Ear earphone, that has 3D stereo sound effects and 3D sound directions working together simultaneously and synchronously to achieve the highest sound quality in 3D stereo space inside small earphone pieces, to minimize hearing damage and loss to an earphone user, and to maximize the 3D stereo sound instantaneous real time effect experienced by the earphone user.

SUMMARY OF THE INVENTION

The present invention provides an earphone, preferably an In-Ear earphone, with multiple speakers, i.e. sound drivers, having a front-and-back straight arrangement at a shared center axis line or different center axes lines for 3D stereo sound effects, with one or multiple speaker elements being disposed in a front portion of an ear cup of the earphone and one or multiple speaker elements being disposed in a back portion of an ear cup of the earphone to provide a third-dimensional (Z) depth sound resonance space for X-Y-Z 3D stereo sound effects and outputs with bass/mid/high sound frequencies. In one aspect, the earphone includes an ear cup containing a unit having multiple speakers arranged straightly with respect to the ear cup with at least one speaker being in front of at least one other speaker, the front and back speakers sharing a center axis line or having different center axes lines for sound waves. The ear cup also contains a front sound effect unit disposed in a front portion of the ear cup and a front sound resonator such as a front sound resonance unit or a front sound resonance area disposed in a front portion of the ear cup, has an even or uneven shaped design with a correspondingly shaped front sound effect unit and front sound resonator, has a sound controller such as a sound control unit or a sound configuration unit disposed in the ear cup, a back sound resonator such as a back sound resonance unit or a back sound resonance area disposed in a back portion of the ear cup, a back sound effect unit disposed in a back portion of the ear cup, a sound output unit connected with the ear cup, a sound balance hole unit, and a back female/joint unit to work with an adjustable holder unit connected to an adjustable ear band unit by attachment and/or detachment functions, for effecting, outputting, and directing 3D stereo sound in three dimensions (X-Y-Z axes).

In one aspect, a unit having multiple speakers is disposed in the ear cup unit of the earphone. This unit includes a small speaker disposed in a front portion of the ear cup, a large speaker disposed in a back portion of the ear cup, the speakers being aligned at a shared center axis line or being aligned at different center axes lines. The small speaker is positioned at front and the large speaker is positioned at the back in order to structure enough sound resonance area to have stereo sound with three-dimensional (X-Y-Z) effects, i.e. real 3D stereo sound effects. The front speaker and the beck speaker work together for a two-dimensional (X-Y) stereo sound wider effect and the back large speaker creates a depth sound in a third-dimension (Z) for X-Y-Z 3D stereo sound effects and an X-Y-Z 3D stereo sound space.

There are many ways to have 3D stereo sound effects of the earphone. The front and back speakers may have different sizes or the same sizes, and may be straightly aligned sharing a center axis line in order to work with the sound effect unit and resonance unit for balanced and equaled 3D stereo sound waves, effects, and outputs.

The front and back speakers, with different sizes or same sizes, may be straightly aligned at different axes lines to work with the sound effect unit, resonance unit, and sound controller to produce 3D (X-Y-Z) stereo sound waves, effects, and outputs.

Another kind of speaker arrangement according to the invention may include the front and back speakers being oriented at angles with respect to each other. For example, the front speaker may be oriented straight with respect to the orientation of the earphone and the back speaker may be oriented with a certain angle with respect to the orientation of the earphone, preferably with a twenty-five degree angle. Alternatively, the front speaker may be oriented with an angle with respect to the orientation of the earphone while the back speaker is oriented straight with respect to the orientation of the earphone. Alternatively, both of the front and back speakers may be oriented at angles with respect to the orientation of the earphone. This angled-arrangement of either of the front or back speakers or both of the speakers causes special sound waves and effects and outputs in three dimensions.

The shape of the ear cup of the earphone is directly related to the front sound effect unit outside the ear cup and/or inside the ear cup. The ear cup shape, usually called the outside of the sound effect wall/unit, can be evenly designed or unevenly designed to work with the inside sound effect unit. The outside front sound effect unit and the inside front sound effect unit may be just one unit with outside wall/face and inside wall/face together, or may be different units. The front sound effect unit is to work with the sound waves of the multiple speakers at the same axis line or different axes lines, and alternatively is to work with the angled-speaker arrangement of the front-and-back multiple speakers for 3D stereo sound effects and outputs. These same principles are also applicable to the back sound effect unit.

The ear cup shape of the earphone is, at the same time, directly related to the front sound resonator inside the ear cup. The front sound resonator inside the ear cup is to work with the sound waves and bounced sound reactions of the front-and-back multiple speakers at the same axis line or different axes lines, or alternatively with the angled-speaker arrangement of the front-and-back multiple speakers for 3D stereo sound effects and outputs. For example, the front sound resonator may have a specially-designed curved shape for inside 3D stereo sound resonance effects and for outside wearing comfort which allows the earphone to fit onto a user's ear that is shaped like a bowl.

The sound controller works with the front and back multiple speakers and analyzes, manages, and configures all digitalized original music data into the front and back speakers to create sound waves that work inside the front sound effect unit, sound resonator, the front portion of the ear cup, the back portion of the ear cup, the back sound effect unit, and the back sound resonator, for two-dimensional wider stereo sound plus stereo sound in a depth of a third dimension at the same time.

In another aspect, the earphone includes an ear cup containing multiple speakers with at least one speaker in the front of the ear cup, at least one speaker in the back of the ear cup, the front and back speakers being straightly arranged along the same center axis line or parallel center axes lines for sound waves. The ear cup also may have at least one three-dimensional direction-adjustable unit connected with at least one of a front end and a back end of the speaker cup, a front sound resonator, an even or uneven shape design with a correspondingly shaped front sound effect unit and front sound resonator, a sound controller, a back sound effect unit, a back sound resonator, and a back female/joint unit to work with an adjustable holder unit connected to an adjustable ear band unit by attachment and/or detachment functions, for effecting, outputting, and directing 3D stereo sound in X-Y-Z axes dimensions.

According to this aspect of the invention, the stereo sound effect and output from an earphone having a 3D direction-adjustable unit has three functions: producing In-Ear stereo sound output that is direction-adjustable, producing In-Ear 3D stereo sound effect that is adjustable in three dimensions, and providing In-Ear wearing comfort at the same time.

Furthermore, the stereo sound effect from an earphone having multiple direction-adjustable units works for a small or big earphone or headphone and has two functions: producing stereo sound output that is direction-adjustable in three dimensions and producing stereo sound effect that is adjustable in three dimensions at the same time.

In another aspect, the earphone includes a wireless carrier unit that may contain a circuit board, a wireless communication chip, e.g. a Bluetooth, a 2.4G, or any other kind of wireless communication chip, a switch unit, a light indicator unit, voice control units, and a microphone unit.

A mother board may be inside the carrier unit. In this aspect, there may also be a CPU unit, a memory unit, a battery unit, and a USB connector unit in the wireless carrier unit. Additionally, there may be a Multiple Player Unit inside the carrier unit.

The wireless earphone contains speaker cup units, front-and-back speakers/units arranged straightly at the same center axis line or different center axes lines, sound controllers, a sound effect unit, sound resonators, speaker output units, and a sound output or direction-adjustable unit for 3D stereo sound effects.

The wireless carrier unit may have a male unit adjustable in three dimensions (X, Y, & Z) attached to the carrier unit to work adjustably with an ear holder unit through a hole or socket female unit. The hole or socket female unit may be designed as a big C style. At the same time, there may be a three-dimensionally rotatable male unit attached to the carrier unit to work adjustably with the speaker cup unit through a socket/female unit.

The wireless earphone may further include an adjustable joint unit disposed on the bottom piece of the ear band unit to facilitate adjustment of the ear band on a user's ear for comfort and stability.

In short, the present invention provides a system that achieves high stereo sound quality with a real time stereo sound in two-dimensional (X-Y) wider sound plus stereo sound in a depth of a third dimension (Z) for X-Y-Z 3D stereo sound effects and outputs by using front and back multiple speakers straightly arranged at the same axis line or different axes lines to create a real 3D stereo sound space or effect.

An object of the present invention is to provide an earphone, such as In-Ear earphone, with multiple speakers in a front-and-back straight arrangement providing adjustable sound effects and outputs in three dimensions with bass/mid/high sound frequencies.

Another aspect of the present invention is to have a back speaker straightly positioned behind the front speaker to create stereo sound waves in a depth of a third-dimension (Z) for stereo sound effect and two-dimensional (X-Y) wider stereo sound for X-Y-Z 3D stereo sound effects.

Yet another object of the present invention is to provide an earphone with front-and-back multiple speakers arranged straightly, i.e. along the same axis line or along different parallel axis lines, to work with sound waves, a sound effect unit, a sound resonator, a sound controller, sound balance hole unit, and a sound output unit for X-Y-Z 3D stereo sound effects and outputs simultaneously and synchronously.

Another object of the present invention is an earphone with front-and-back multiple speakers straightly arranged at the same axis line or different axes lines to work with sound waves, a sound effect, a sound resonator, a sound controller, a sound balance hole unit, and one or multiple direction-adjustable sound output units for X-Y-Z 3D stereo sound effects and outputs and a 3D direction-adjustable stereo sound simultaneously and synchronously.

Yet another object of the present invention is to provide an earphone with different shapes and functions of the ear cup. The ear cup contains different shapes and functions of a sound effect unit and of a sound resonator and of a sound balance hole unit to work with the front-and-back multiple speakers arranged straightly at the same axis line or different axes lines for a better stereo sound space and effect in X-Y-Z three dimensions. The sound resonator can produce an improved harmony.

Another object of the present invention is to provide an earphone with front and back speakers with the back speaker or front speaker positioned at an angle for X-Y-Z 3D stereo sound space and effect.

Yet another object of the present invention is to provide an earphone with a different quantity of front and back multiple speakers straightly aligned at the same axis line or different axes lines, or a different size thereof, such as an earphone with one small speaker at front and one large speaker at back, two small speakers at front and one large speaker at back, or all front and back speakers having the same size or different sizes, etc., for depth stereo sound effects in a third dimension.

Another object of the present invention is to provide an earphone having front-and-back multiple speakers arranged straightly and having an attachable or detachable joint structure and function for the ear cup to work with an ear band unit and ear cup holding unit for wearing comfort and hearing safety with 3D stereo sound effects and direction-adjustable 3D-sound at the same time. The ear band may have an adjustable joint part.

Yet another object of the present invention is to provide an earphone having multiple speakers straightly arranged in front and back with changeable sound effects, output structures, and functions for inputting into a user's ear tunnel. The earphone provides wearing comfort and sound hearing safety while providing 3D stereo sound effects and adjustable sound direction in three dimensions at the same time.

Another object of the present invention is to provide an earphone with X-Y-Z 3D stereo sound wireless communication function and structure including an ear cup unit containing all above mentioned units, functions, and structures for X-Y-Z 3D stereo sound effects and 3D direction-adjustable sound.

Yet another object of the present invention is to maximize the three basic considerations of an In-Ear earphone: small size, real 3D stereo sound quality with bass/middle/high sound frequencies, and wearing/hearing comfort, within a very small, closed, and isolated sound space and output environment and structure.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, similar reference characters denote similar elements throughout the several views.

DESCRIPTION

Figure 1:
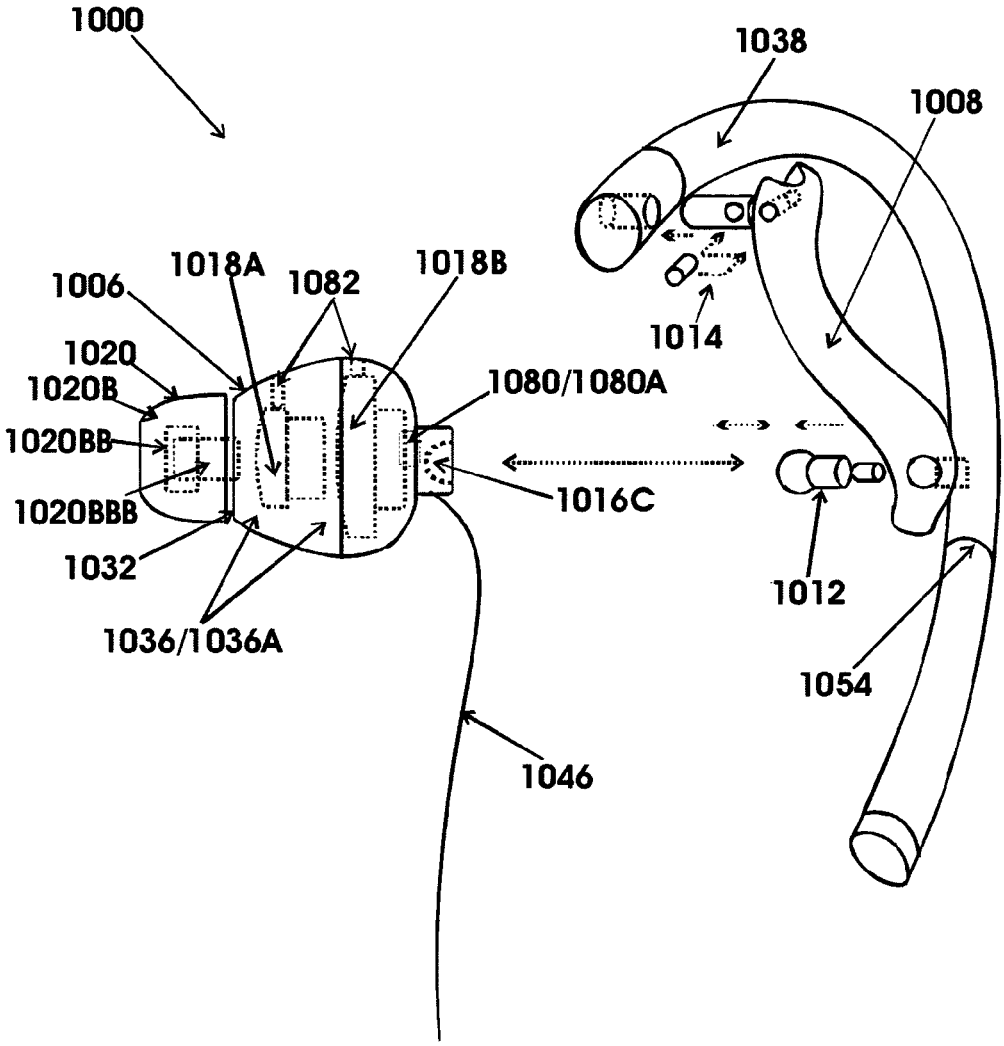
FIG. 1 is a side view of an earphone in accordance with a first embodiment of the invention.
Figure 2:
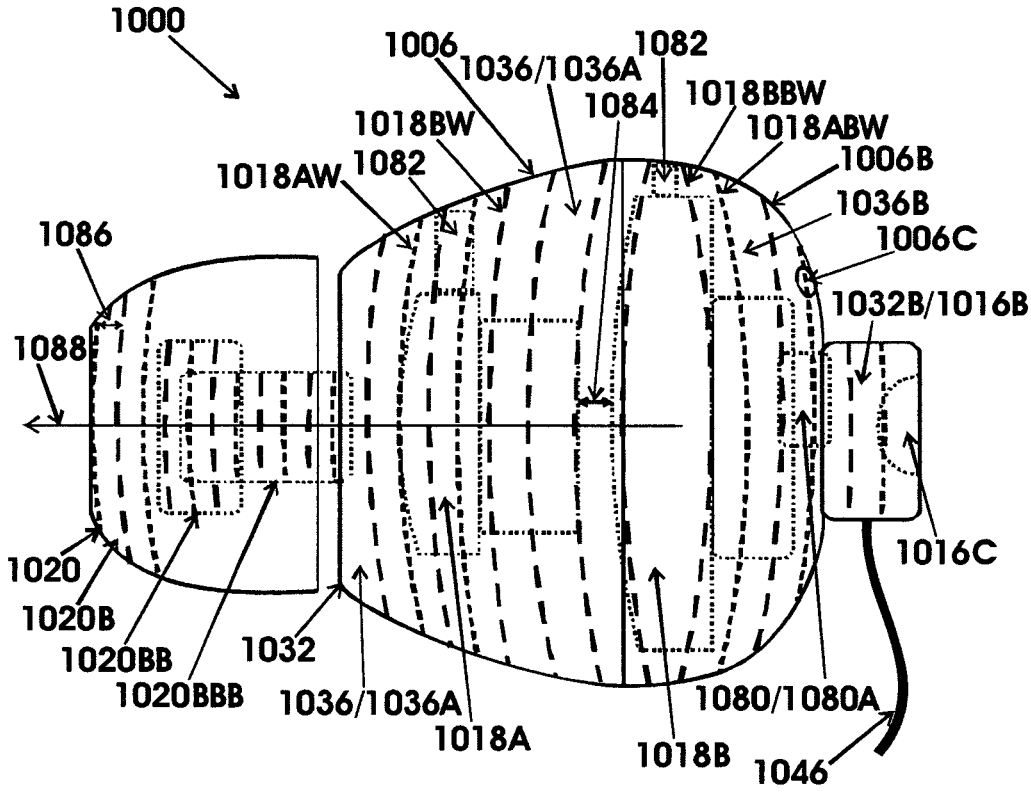
FIG. 2 is an enlarged side view of a portion of the earphone shown in FIG. 1.
Figure 4:
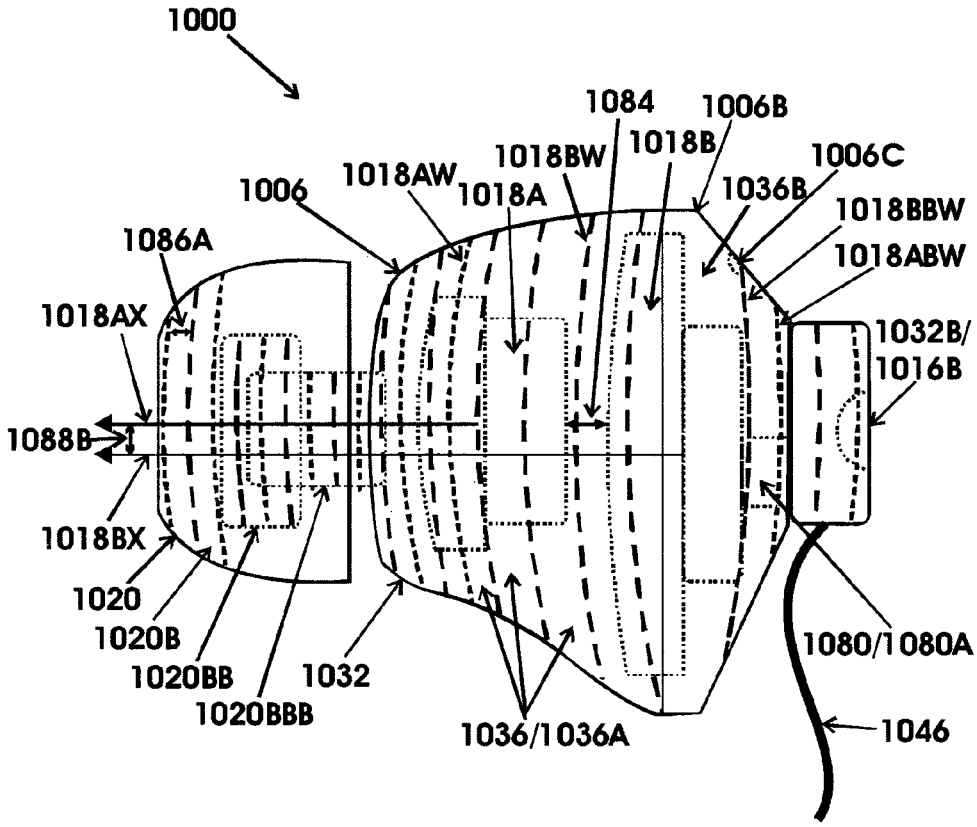
FIG. 4 is an enlarged side view of another embodiment in accordance with the invention.

FIGS. 1, 2, 4, and 6 show an earphone 1000 which may be the left or the right portion of the earphone or headset for providing 3D stereo earphone with multiple speakers inside, and show various speaker cup units 1006 with front/back speakers 1018A and 1018B for X-Y-Z 3D stereo sound effects with bass/middle/high frequencies of sound. In the embodiments shown in FIGS. 1, 2, and 4, front/back speakers 1018A and 1018B are straightly arranged along the same axis line or along different parallel axis lines. In FIGS. 1 and 2, speakers 1018A and 1018B share center axis line 1088. In FIG. 4, speakers 1018A and 1018B are arranged along different axis lines 1018AX and 1018BX that are parallel to each other. In the embodiment shown in FIG. 6, speakers 1018A and 1018B have an angled orientation.

Speaker cup unit, i.e. ear cup 1006 is designed for an In-Ear earphone 1000 with a center speaker unit containing two speakers (sound drivers) 1018A and 1018B arranged in a front/back straight array with a front sound effect unit 1032 and a front sound resonator 1036/1036A. The front sound effect unit can also produce sound resonance. In order to form these two speakers (double sound drivers) in this front and back straight array, one speaker 1018A is located at the front of the earphone to handle high frequency of sound. Another speaker 1018B is located at the back of the earphone to handle bass (low) and middle frequencies of sound. In a reversed way, the front speaker 1018A could handle bass sound and the back speaker 1018B could handle middle and high frequencies of sound. There are many possible ways to design the arrangements of each speaker for handling different sound frequencies.

The small high definition driver 1018A is directly arranged in the front side of the earphone and the large high efficiency driver 1018B is straightly arranged in the back side of the small driver 1018A with a specially-designed sound controller 1080/1080A for a very strong bass and sympathetic response. The sound controller 1080/1080A is a specially-designed frequency configuration unit in this embodiment. Having the double speakers 1018A and 1018B in a front/back straight arrangement creates a stage-like real sound delivery system or a X-Y-Z three dimensional (3D) sound stereo space because the double speakers 1018A and 1018B explore stereo sounds in X-Y axes senses in a wide horizontal way for two dimensional sound, plus, at the same time, the back large speaker 1018B delivers a very strong bass and middle sounds from the back to front to provide a third dimensional (Z-Axis) stereo sound in a deep straight vertical way for three dimensional (X-Y-Z axes) stereo surrounding sound effects with bass/mid/high sound frequencies.

The different arrangements of speakers disclosed may include the front and back speakers facing the same direction, facing the same direction offset at an angle, facing each other directly, or facing each other offset at an angle.

Therefore, a listener can hear a strong bass sound from deep back to near front in a powerful sound wave with a Z-axis deep sense. At the same time, the listener can hear real stereo sounds with X-Y axes in very detailed form from front, from left, from right, from back, and from everywhere the stereo music is destined to play in three dimensions (3D) X-Y-Z) with full-scaled sound frequencies of bass/middle/high.

The 3D stereo sound is for a sound space and effect in three dimensions (X-Y-Z). The three-sound frequencies of bass/middle/high are only for different sound volumes and contents, maybe in X-Y two-dimensional sound space, or maybe in X-Y-Z three-dimensional sound space. The Z-axis depth stereo sound is the key element of X-Y-Z 3D stereo sound space and effect. Only with a Z-axis depth stereo sound, can the three sound frequencies of bass/middle/high be simultaneously and synchronously achieved for X-Y-Z 3D sound space or effect.

The size arrangements of the front speaker 1018A and back speaker 1018B are preferably a small sound driver at front and a large sound driver at back, or the same size at front and back, or a large at front and a small at back, etc., if needed.

The arrangement, design, function, shape, form, size, structure, location, type, and material of the double drivers front/back straight array unit of back large speaker 1018B and front small speaker 1018A may vary if needed to apply into the various embodiments of earphones shown in FIGS. 1 to 19.

With different shapes and functions of the ear cup 1006, there are different shapes and functions of front sound effect unit 1032, front sound resonator 1036/1036A which can be a harmony unit, and sound balance hole unit 1006C to work with the front and back straightly arranged multiple speakers at the same axis line or different axes lines for a better stereo sound space and effect in three dimensions (X-Y-Z).

The front sound effect unit 1032 and front sound resonator 1036/1036A which can be a front sound resonance area or a front sound resonance unit also include a space of the front speaker 1018A and the area between the front speaker 1018A and the back speaker 1018B. Due to natural properties of a sound wave, sound bounce, sound re-bounce, and sound gravity, the sound effect unit 1032 and sound resonator 1036/1036A work with the sound waves 1018AW and 1018BW for 3D stereo resonance and harmony sound effects. The different sizes, shapes, and structures of the front sound effect unit 1032 and of the sound resonator 1036/1036A cause different 3D stereo sound resonance and harmony effects.

The size, shape, function, structure, design, and material of the sound effect unit 1032 and of the sound resonance unit 1036/1036A may vary.

The computerized sound controller 1080 which can be a wave/level/frequency controller unit is inside the ear speaker cup unit 1006 containing the multiple speaker center unit. Also, the sound controller 1080 may contain a sound unit 1080A. Sound unit 1080A controls the sound system and/or the sound frequency configuration system of multiple speaker units that includes front speaker 1018A and back speaker 1018B.

The sound controller 1080 directs the high sound into the first speaker 1018A and directs the bass/middle frequencies of sounds into the second speaker 1018B in order to achieve and best balance the stereo sound effects for a very strong and powerful bass and resonance/harmony performance stereo in three dimensional (3D) sound effects under the double drivers straight array.

The design, function, material, shape, size, type, and location of the sound controller 1080/1080A may vary.

The double drivers front/back straight array unit of speakers 1018A and 1018B works with a sound effect unit 1032 and resonant function unit/area 1036/1036A for better 3D stereo sound outputs, hearing safety, and wearing comfort, at the same time.

Inside a front sound output unit 1020 of the ear speaker cup unit 1006 is a sound delivery and filter unit 1020B containing the inside sound output unit 1020BB and inside sound focus piece 1020BBB for an In-Ear style of earphone.

The front sound output unit 1020 with sound delivery and filter unit 1020B and inside sound output unit 1020BB disposed inside is shaped like a mushroom head or has a duck mouth shape in order to get in a user's ear tunnel fully, tightly, and comfortably to minimize outside unwanted sound to achieve a special sound environment inside the ear cup 1006 from the specially arranged sound sources 1018A and 1018B, to the sound effect area 1032 and resonance areas 1036/1036A, and to the output unit 1020 into a user's ear tunnel directly and closely for X-Y-Z 3D stereo sound effects and outputs.

The sound focus piece 1020BBB concentrates all sounds from the speaker unit into the inside sound output unit 1020BB to achieve In-Ear stereo sound output. The speaker unit may contain one speaker, two speakers, such as speakers 1018A and 1018B, or more speakers.

Also, the inside sound output unit 1020BB has a sound isolation function to isolate outside noises and unwanted sounds.

The mushroom head or duck mouth shape of sound output unit 1020 is removable and replaceable if needed for different human ears, and is exchangeable with other sound output designs, such as those having an In-Ear style, an Onto-Ear style, an On-Ear style, etc. In other words, the sound output units 1020, 1020A, 1020AA, 1020AAA, 1020B, 1020BB, and 1020BBB are all interchangeable and replaceable if needed.

The size, design, shape, location, method, and material of the sound output-delivery/focus units 1020, 1020B, 1020BB, and 1020BBB and speaker cup unit 1006 may very.

There is a speaker base unit 1082 to hold the speakers 1018A and 1018B inside the cup 1006. The design, function, size, shape, location, and material of the speaker holding unit 1082 may vary if needed to apply to all of the embodiments shown in the FIGS. 1 to 19.

A socket/female joint unit 10160 located at the back side of the cup unit 1006 works with a speaker cup holding unit 1008 and ear band unit 1038 via an attachable and detachable function and structure if needed.

Because the present improvement was simultaneously researched and developed together with the invention of the Sound Direction/Stereo 3D Adjustable Earphone of U.S. Pat. No. 7,697,709, the unit 1016C may work with the detachable speaker cup holding unit 1008 through the ball/male unit 1012 for attachment or detachment functions and structures.

The unit 1008 works with the ear band unit 1038 through the attachment and detachment unit 1014. With the attachable/detachable unit 1016C, the speaker cup unit 1006 may work with the sound 3D adjustable direction units 1008/1038 to independently achieve holding and adjusting functions for hearing comfort, hearing safety, wearing comfort, and wearing stability, for example so that the earphone may be worn for sports.

The attachment/detachment socket/female joint unit 1016C and the ball/male unit 1012 may be reversed so that the ball/male unit is on the back side of the cup unit 1006 and the socket/female joint unit is with the holding unit 1008.

The design, function, size, shape, location, method, and material of the unit 1016C may vary.

A wire line 1046 may connect earphone 1000 to any suitable audio/visual player. Wire line 1046 may also be replaced via a wireless unit (not shown). A microphone with a volume/MP controller (not shown) may be attached on the wire unit 1046.

A joint part 1054 on the ear band 1038 adds joint movement function and structure. The ear band 1038 can be adjusted or bended at the joint part 1054 to follow a user's ear shape for wearing comfort and stability. Joint part/unit 1054 can be any kind of joint part, structure, method or material and can be any size.

In addition, earphone 1000 may contain well-known devices and features (not shown) such as a micro central processing unit/multichip package (CPU/MCP) unit and a mini memory unit, a light emitting diode (LED) or liquid crystal display (LCD) unit, a computerized level controller unit, an attachable universal serial bus (USB) stick or disc unit, a mini speaker unit, a switch unit and voice volume controller, a wireless or cable unit, a circuit board unit, a battery unit, a microphone unit, an integrated micro sound amplifier unit, a sound purifier unit, an internal or external antenna unit, a wireless unit, and an Internet protocol (IP) based communicator unit. The attachable USB stick or disc unit may contain a micro CPU/MCP unit and memory unit. The switch unit and voice volume controller unit may be in a key style, a wheel style, a touch panel style, or a digital LED/LCD screen selection style. The micro CPU/MCP unit (digital signal processor) may provide full range digital audio. The wireless unit may deliver to or receive from a circumaural wireless stereo radio frequency (RF) system, or an internet server system.

The CPU/MCP unit may contain a digital signal processor providing full range digital audio output of earphone 1000.

Therefore, 3D stereo earphone 1000 may be used wirelessly or through a cable in a regular earphone system, a regular headset/headphone system, a cell phone, a multiple player, a radio system, a telephone system, a personal computer (PC) system, a notebook computer, an internet communication system, a cellular/satellite communication system, a home theater system, a car/ship/airplane audio system, a game, ear hearing assistance equipment, or medical equipment.

FIG. 2 explores further the present development of earphone 1000 in detail.

As shown in the enlarged drawing of earphone 1000, the small speaker 1018A and large speaker 1018B work together to form the double drivers front/back straight array unit. The front speaker 1018A delivers a sound wave 1018AW having a high sound frequency. The back speaker 1018B delivers a sound wave 1018BW having bass and middle sound frequencies. The sound waves 1018AW and 1018BW work together to form 3D stereo sound effects in the X-Y-Z axes, or in other words, a 3D (X-Y-Z) stereo sound space, with bass/mid/high sound frequencies. The sound wave lines 1018AW and 1018BW can be in parallel at the same distance, can cross over, or can be oriented at different angles based on the position arrangements of the front and back speakers.

A distance 1084 is between the speakers 1018A and 1018B. A sound depth 1086 is between speaker sound waves 1018AW and 1018BW. The sound depth 1086 is a key element for real 3D stereo sound effects. The sound depth 1086 is directly related to the distance 1084 and reacts with sound effect unit 1032 and sound resonant unit 1036/1036A for sound having depth in the third dimension along the Z axis.

The position arrangement of those two speakers 1018A and 1018B is very important, preferably with one in front and one in back in a straight array along a shared, i.e. the same, center axis line 1088, which in this embodiment also represents a horizontal axis of the ear cup 1006. The axis line 1088 is a center point line of the multiple speakers 1018A and 1018B. Those front and back speakers 1018A and 1018B are all aligned straightly standing and facing out at 90 degrees with respect to this axis line 1088.

The orientation of the speakers along this same axis line 1088 helps the sound waves 1018AW and 1018BW and the depth 1086 to develop at the same wave shape, wave rate, and wave distance for even and equal 3D stereo sound effects. Similarly, this straight array with the speakers having the same center axis 1088 also allows the focus points and wave out lines of the sound waves 1018AW and 1018BW to be evenly and equally distributed around the center area of 3D stereo sound space.

More importantly, the depth 1086 determines the Z axis depth development of 3D stereo sound of the double drivers front/back straight array unit in the X-Y-Z axes sound effects. If the depth 1086 is too big, it may over-react the Z axis development of 3D stereo sound of the double drivers front/back straight array unit. If the depth 1086 is too small, it may weaken the Z-axis development of the 3D stereo sound of the double drivers front/back straight array unit. Many experiments are needed to get the depth 1086 in the right position for different kinds of speakers, not only for Z-axis sound effect or development, but also for X-Y axes sound effects or development.

First, the depth 1086 needs to be the right amount for better sound effects in all three dimensions along the X, Y, and Z axes. The right amount of the depth 1086 is directly related to the distance 1084, and is preferably one to two mm between the speakers 1018A and 1018B. If the distance 1084 is less than one mm, the speakers 1018A and 1018B may touch each other during vibration of the sound waves. If the distance 1084 is bigger than two mm, it may cause the depth 1086 to be too big.

Second, at the same time, the depth 1086 may be influenced when the speaker sound waves 1018AW and 1018BW work within the sound resonator 1036/1036A. The sound resonator 1036/1036A has an outside shape and an inside space to create certain sound resonance/harmony effects. Due to natural properties of a sound wave, sound bounce, sound rebounce, and sound gravity, the different sizes, shapes, and structure of the front sound effect unit 1032 and the sound resonator 1036/1036A cause different 3D stereo sound resonance and harmony effects. If the sound resonator 1036/1036A is too tight or small for the work of speaker sound waves 1018AW and 1018BW, the depth 1086 may be distorted. If the sound resonator 1036/1036A is too loose or big for the work of speaker sound waves 1018AW and 1018BW, the depth 1086 may be weakened or not well.

Third, at the same time also, the depth 1086 may be influenced when the speaker sound waves 1018AW and 1018BW work with the sound effect unit 1032. The sound effect unit 1032 has an outside shape and an inside shape to create certain sound effects, and is usually an outside shell with a sound effect, or an inside sound effect piece or wall. If the sound effect unit 1032 is too straight or curved for the work of speaker sound waves 1018AW and 1018BW, the depth 1086 may be distorted or weakened or not well.

There is a very small, limited and closed sound working space inside the speaker cup 1006. So, within that very limited sound working space, the sound waves 1018AW and 1018BW of the speakers 1018A and 1018B, respectively, the straight array same axis line 1088, the depth 1086, the distance 1084, the front sound effect unit 1032, the sound resonator 1036/1036A, and the sound output unit 1020 are all very critical for working together well and synchronously in the creation of 3D stereo sound in X-Y-Z dimensions.

The location, size, design, shape, function, and material of elements and features 1032, 1036/1036A, 1018AW, 1018BW, 1084, 1086, 1088, and 1006 may vary if needed to apply to the various embodiments shown in FIGS. 1 to 19.

Because the sound wave is three-dimensional, when sound waves 1018AW and 1018BW wave closely into the front area 1036 and sound output unit 1020 of the ear cup 1006, the sound waves 1018ABW and 1018BBW wave closely into the backside 1006B of the earphone cup 1006 which has a back sound resonator 1036B and a back sound effect/female joint unit 1032B/1016B. The sound waves 1018AW and 1018BW may bounce off the sound effect unit 1032 and resonator unit 1036/136A thereby becoming the back sound waves 1018ABW and 1018BBW, as the speakers are generally made to deliver sound towards the front. The speakers may, however, be made to deliver sound towards the front and back so that back sound waves 1018ABW and 1018BBW emerge directly from the speakers in the direction of the back of the earcup. Holes 1006C may be at the front and back of the earcup in order to balance out the sound waves at both ends. The speakers may even deliver sound in all directions, i.e. in 360 degrees. The sound waves 1018ABW and 1018BBW wave into the backside 1036B to create the back sound effects through working with the back sound resonator 1036B and back sound effect/female joint unit 1032B/1016B. The back sound resonator 1036B may be a back sound resonance area or a back sound resonance unit. One or more backside holes 1006C release the back sound waves 1018ABW and 1018BBW in order to balance a better front resonance and sound outputs for 3D stereo sound effects. The back sound effect/female joint unit 1032B/1016B contains the back sound effect unit 1032B and the back attachable or detachable female joint part 1016B to work with the sound 3D adjustable direction units 1008/1038 (shown on FIG. 1) if needed to independently achieve holding and adjusting functions for earphone 1000 hearing comfort and safety. The joint part 1016B could be a male part or any kind of adjustable unit.

The backside hole unit 1006C may be located in the front, at a side, or at the bottom of the earphone and may be any kind and have any size and shape if needed.

The sound controller 1080/1080A configures music-player, original, sound-stereo frequencies into the speakers 1018A and 1018B. The sound controller 1080 may contain a capacitor unit 1080A with a capacitance of 4.7 uF for more accurate configuration of original-sound digital signals from the music player. The capacitor unit 1080A may have any capacity and be any kind, size, or type of capacitor. Preferably, the sound controller 1080/1080A configures high frequency into the front speaker 1018A and bass/middle frequencies into the back speaker 1018B synchronously. Of course, there are many possible ways of stereo sound configuration for achieving better sound stereo output with minimized digital sound loss or distortion. For example, the sound controller 1080/1080A may configure bass frequency into the front speaker 1018A and high/middle frequencies into the back speaker 1018B synchronously.

The location, size, design, shape, function, and material of elements or features 1032B/1016B, 1036B, 1018ABW, 1018BBW, 1006B, 1006C, and 1080/1080A may vary if needed to apply to all of the embodiments shown in FIGS. 1 to 19.

Figure 3:
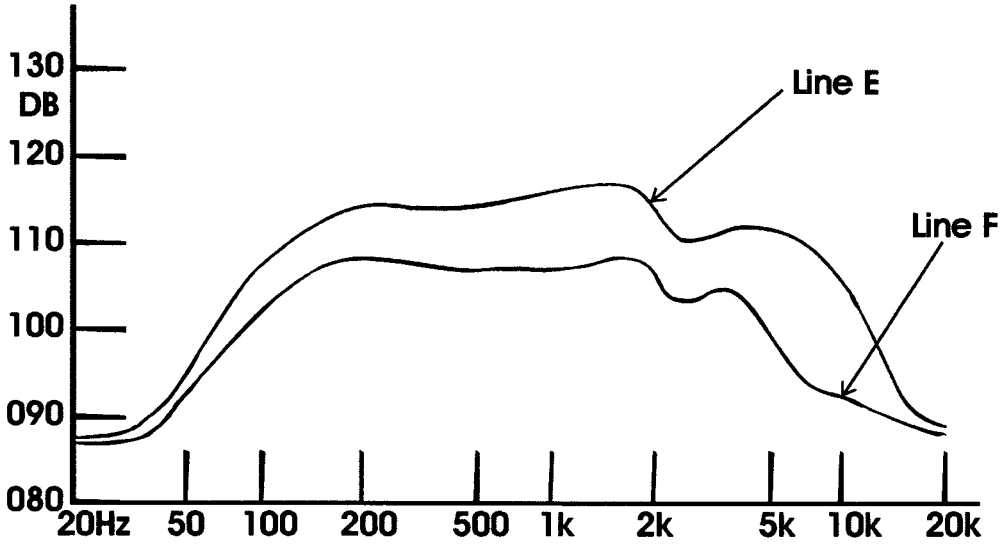
FIG. 3 is a chart of sound stereo wave/level frequency wave lines in association with the embodiment shown in FIGS. 1 and 2.

FIG. 3 shows different sound wave lines E and F caused by earphones having different depths 1086 when the front and back speakers are straightly arranged at the same center axis line 1088. The Line E is a sound wave line when the depth 1086 is kept at one mm. The sound output volume of the Line E is very high and strong. The sound wave change of the Line E is very natural and balanced. The Line F is a sound wave line when the depth 1086 is kept bigger than two mm. The sound output volume of the Line F is smaller and weaker. The sound wave change of the Line F is not very natural and balanced. Obviously, the Line E sound output is much better than Line F sound output for 3D (X-Y-Z) stereo sound effects.

Of course, the depth 1086 when the speakers are straightly arranged at the same center axis line 1088 may vary in order to achieve different sound output stereo 3D effects as the original stereo music requires.

FIG. 4 shows another embodiment in which ear cup 1006 has an uneven shape and contains the front/back speakers 1018A and 1018B straightly arranged at the front and back of the earphone with an axis width 1088B between different center axis lines 1018AX and 1018BX of speakers 1018A and 1018B, respectively. The width 1088B is caused by the speaker 1018A straightly arranged at the front of the earphone with a center axis line 1018AX that is upwards from the center axis line 108BX of speaker 1018B, and by the speaker 1018B straightly arranged at the back of the earphone with a level axis line 1018BX downwards from the center axis line 1018AX of speaker 1018A. The axis lines 1088AX and 1088BX are center point lines of the multiple speakers 1018A and 1018B which are aligned at the front and back of the earphone at different levels and straightly stand facing out at ninety degrees.

Therefore, the two speakers 1018A and 1018B are straightly arranged at the front and back of the earphone with different center axis lines 1018AX and 1018BX, respectively, with an axis level difference of width 1088B. The width number of 1088B is the distance between 1018AX and 1018BX. Through many experiments, the width number of 1088B has been found to produce better 3D stereo sound effects when it is in the range between one mm and three mm.

With the width 1088B, the stereo sound output 1018AW and 1018BW of the speakers are at different axis lines 1018AX and 1018BX, respectively, with different wave rates and shapes. It is very critical to control those sound waves and shapes mixed together into a user's ear for better 3D stereo sound effects that are much closer to the original stereo music.

The depth 1086A is affected by the width 1088B and the different shapes/shock rates of the sound waves 1018AW and 1018BW. As a result, the depth 1086A determines the Z axis depth development of 3D stereo sound of the front and back speakers 1018A and 1018B straightly arranged at the different axes lines 1018AX and 1018BX, respectively, for X-Y-Z axes 3D stereo sound effects.

The front sound effect unit 1032, the front sound resonance effect unit 1036/1036A, the back cover 1006B, the back sound resonance effect unit 1036B, and the back sound effect unit 1032B/1016B all have uneven and different shapes.

Those units 1032, 1032B, 1036/1036A, 1036B, 1016B, and 1006B all work with the width 1088B of the different axis line positions of the speakers 1018A and 1018B for better 3D stereo sound effects. Through the special configuration unit 1080/1080A, the sound waves 1018AW and 1018BW with different wave axis lines 1018AX and 1018BX work inside those units 1032, 1032B, 1036/1036A, 1036B, 1016B, and 1006B and with the width 1088B to bounce, mix, and balance sound effects for better X-Y-Z 3D stereo sound effects into a user's ear.

The shape, location, function, size, material, and method of those units or features 1018AX, 1018BX, 1088B, 1032, 1032B, 1036/1036A, 1036B, 1016B, and 1006B may vary if needed to apply to the various embodiments shown in FIGS. 1 to 19.

Figure 5:
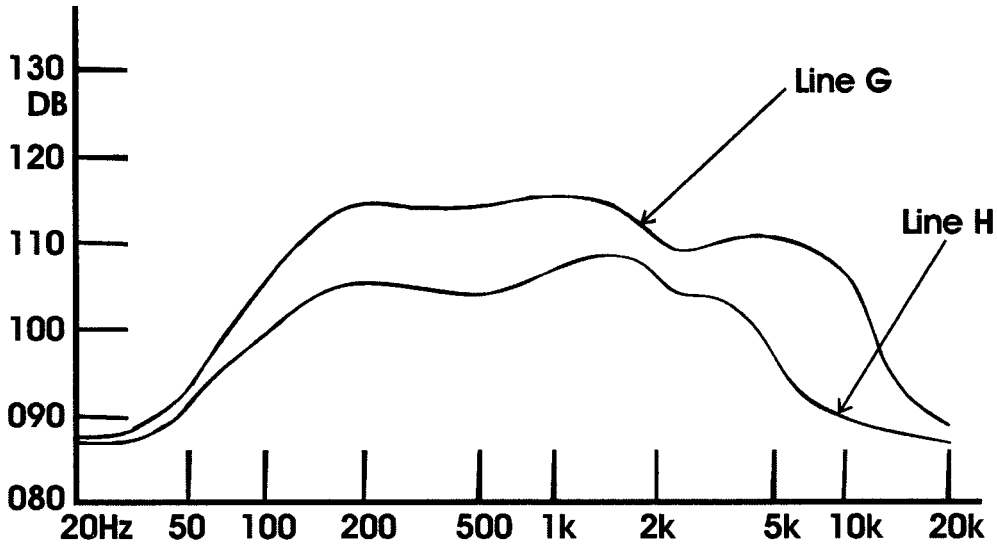
FIG. 5 is a chart of sound stereo wave/level frequency wave lines in association with the embodiment of FIG. 4.

FIG. 5 shows different sound wave lines G and H caused by earphones having different widths 1088B for the embodiment of earphone shown in FIG. 4 with speakers straightly arranged at different center axis lines. The Line G is a sound wave line when the width 1088B is kept at a distance of between 1 mm and 3 mm. The sound output volume of the Line G is very high and strong. The sound wave change line of the Line G is very natural and balanced. The Line H is a sound wave line when the width 1088B is kept bigger than 3 mm. The sound output volume of the Line H is smaller and weaker. The sound wave change line of the Line H is not very natural and balanced. Obviously, the Line G sound output is much better than the Line H sound output for X-Y-Z 3D stereo sound effects.

Of course, the speakers that are straightly arranged at the different center axis lines 1018AX and 1018BX may have the width 1088B be varied due to different sizes and types of speakers in order to achieve different sound output stereo X-Y-Z 3D effects as the original stereo music requires.

Figure 6:
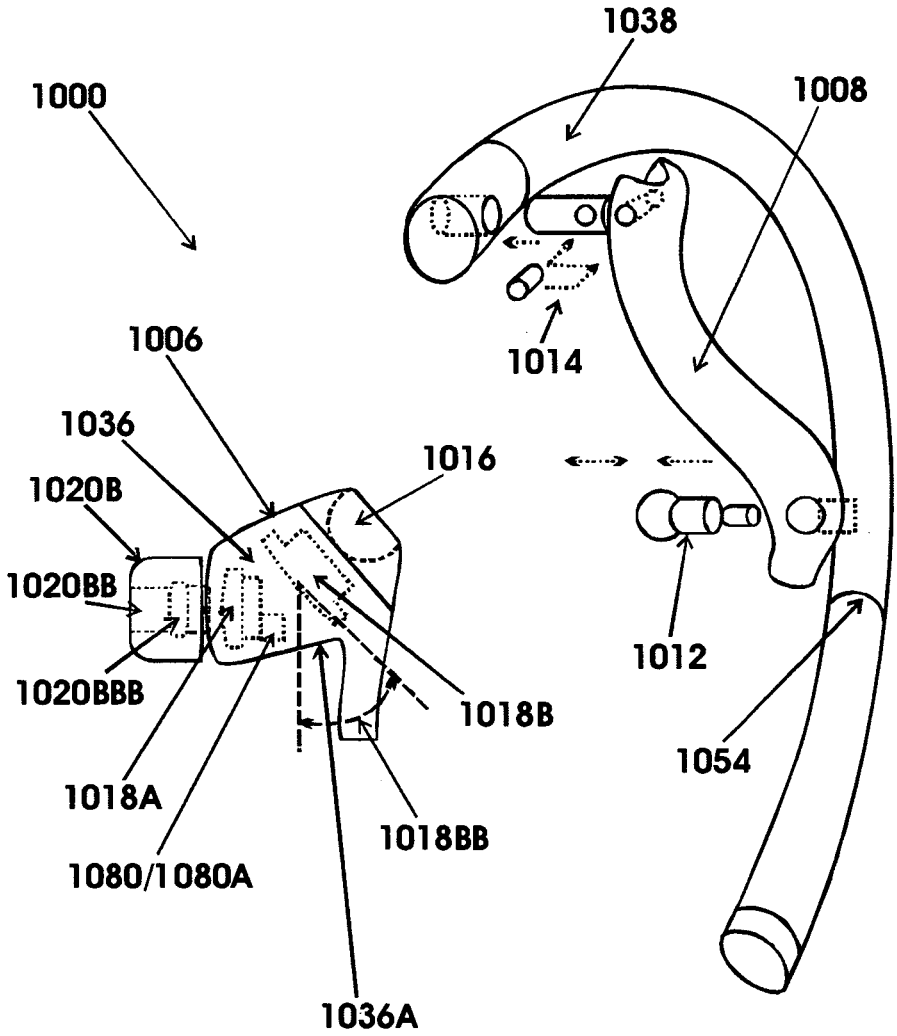
FIG. 6 is a side view of another embodiment of one earphone in accordance with the invention.

FIG. 6 shows an embodiment of earphone according to the invention that has a center speaker unit containing two speakers 1018A and 1018B that are oriented at angles with respect to each other in an angle direction structure 1018BB. One speaker 1018A is located at the front of the speaker to handle high frequency of sound. Another speaker 1018B is located at the back of the earphone to handle bass and middle frequencies of sound. The sound unit 1080A directs the high sound into the first speaker 1018A and directs the bass/middle frequencies of sounds into the second speaker 1018B in order to achieve and best balance the 3D stereo sound effects. The back speaker 1018B may be arranged at an angled position 1018BB or in a vertical way (i.e. at an angle of ninety degrees). The angle direction or position of the back speaker 1018B may be adjustable to achieve better 3D stereo sound delivery, especially for Z-axis deep sound effect. The speakers in the angled position 1018BB work with the sound resonance area 1036 to create sound resonance and harmony. As the angle degree of angle position 1018BB is larger, preferably at an angle of twenty-five degrees, the sound bass resonance and harmony of the speaker unit 1018 will be stronger in a Z-axis deep sense.

When the speaker driver 1018B is oriented at a vertical angle (90°) with respect to speaker 1018A, there may be a sound effect unit 1032 and a sound resonator 1036 to work with that structure for other kinds of better 3D stereo sound effects.

Sound wave movement is bounce-able. When the speaker driver 1018B has the angled structure 1018BB, the sound from the speaker driver 1018B will be hit and bounced back within the sound effect unit 1032 and the resonator 1036 to cause sound shock waves for better 3D X-Y-Z stereo sound output for full-scaled sound frequencies, especially, bass sound and middle sound in a Z axis deep sense because the back speaker 1018B outputs stronger sounds from the back side to front side.

The speakers having the angled structure 1018BB work with the resonator 1036, which is designed with a special structure 1036A for an effect of inside sound resonance and an effect of outside wearing comfort. The outside specially-designed structure 1036A has an upwardly-curved shape for human ear wearing comfort. In other words, the unit 1036A has two functions: one for an inside sound effect of stereo resonance working with the angled orientation 1018BB of the speakers, another one for providing comfort to the ear of the person wearing the earphone.

This method not only creates better sound 3D stereo output, but also creates a better shape and structure of the speaker cup unit 1006 for a user to put the earphone 1000 into his ear in a comfortable and stable manner.

Sound wave movement is naturally absorbed by gravity, from bass sound frequency first, to middle sound frequency, and then to high sound frequency. When the speaker cup unit 1006 is adjusted in a 3D direction by using the female unit 1016C together with the adjustable ear band units 1038, 1008, 1012, and 1014 (referenced in FIG. 1), the angle function 1018BB angle degree is changed accordingly due to the differing effects of gravity. Therefore, the 3D stereo sound direction and output of the earphone 1000 can be changed by self adjustment of the user for better stereo effect, hearing safety, and wearing comfort.

The design, size, shape, function, location, and material of the angle unit 1018BB may vary if needed to apply into the various embodiments shown in FIGS. 1 to 19.

Figure 7:
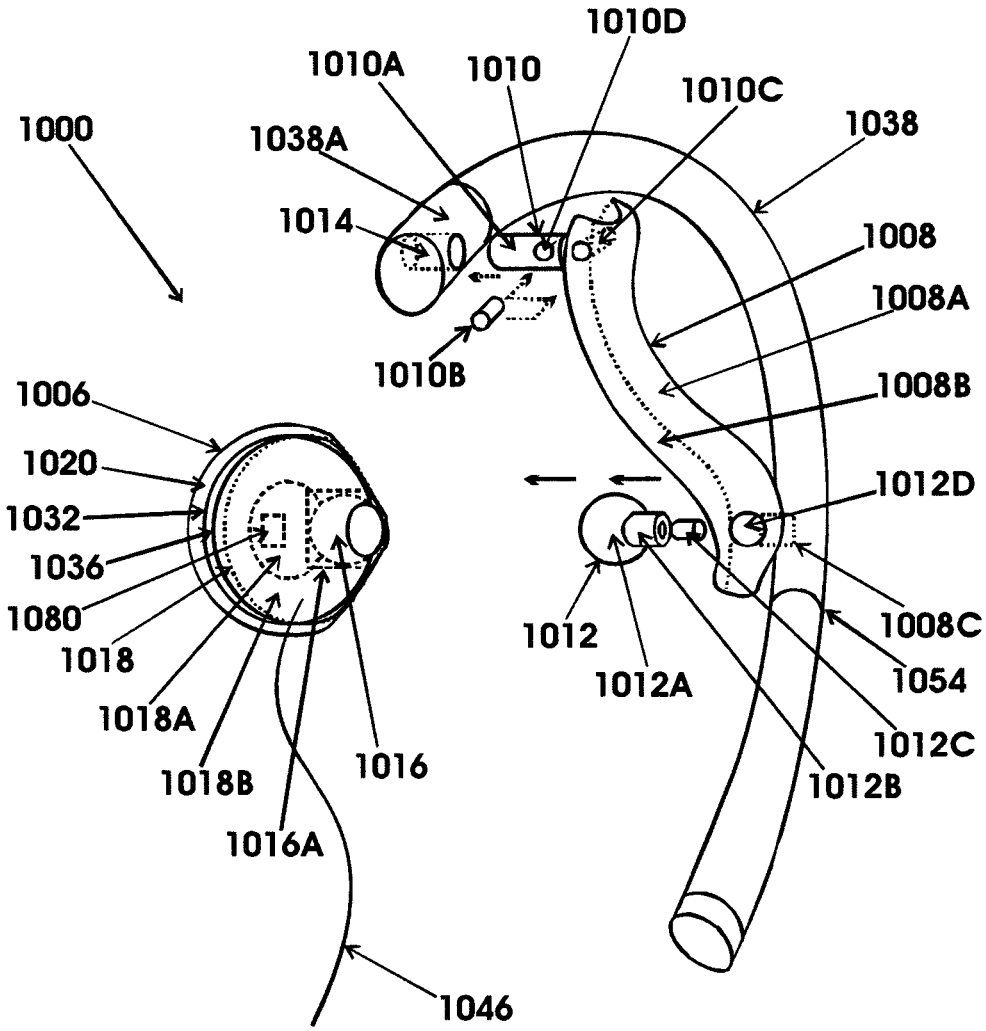
FIG. 7 is a back view of another embodiment of one earphone in accordance with the invention with a rear view of a portion of the earphone.
Figure 7A:
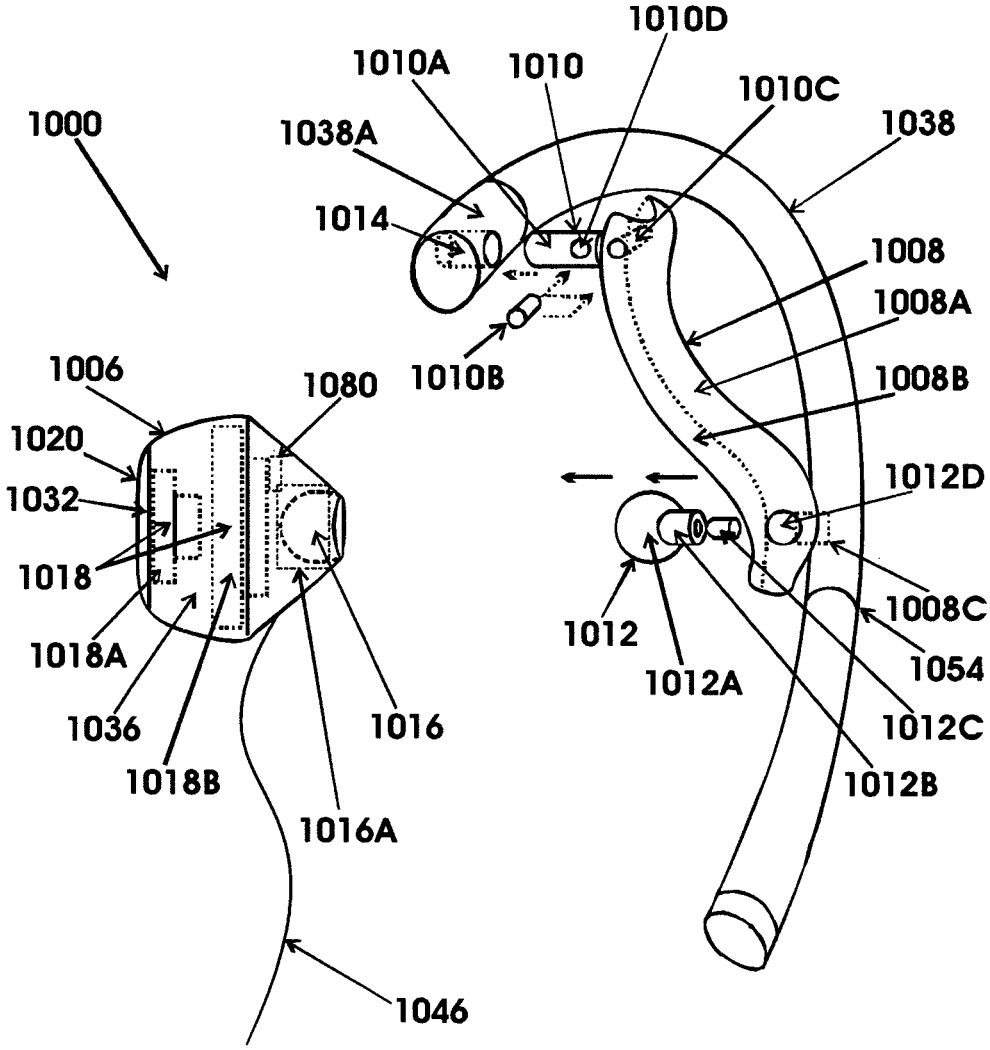
FIG. 7A is a side view of the embodiment shown in FIG. 7.

FIG. 7 and FIG. 7A show that the center speaker unit 1018 contains two speakers 1018A and 1018B. One speaker 1018A is designed to handle high frequency of sound. Another speaker 1018B is designed to handle bass and middle frequencies of sound. The sound controller 1080 directs the high sound into the first speaker 1018A and directs the bass/middle frequencies of sounds into the second speaker 1018B in order to achieve and best balance the stereo sound effects.

When the center speaker unit 1018 contains one, two, three, or more speakers, the sound controller 1080 analyzes and manages all sound levels and frequencies and directs them to the appropriate speakers for the best 3D adjustable stereo sound effects.

The material, design, form, shape, size, type, structure, and function of all speaker units and speakers 1018, 1018A, and 1018C may vary.

There are left and right earphone pieces of earphone 1000. Each earphone piece has a speaker cup unit 1006 containing one sound controller 1080 and two speakers 1018A and 1018B. Accordingly, there are in total two sound controllers 1080, two speakers 1018A, and two speakers 1018B within one earphone 1000 to create true 3D stereo sound effects.

The sound controller 1080 and sound unit 1080A may be combined into one piece or different pieces. The size, design, method, system, location, and material of the sound controller 1080 and sound unit 1080A may vary.

The computerized sound controller 1080 which can control waves, levels, and frequency in ear speaker cup unit 1006 containing speaker center unit 1018 also detects and analyzes the direction changes of speaker unit 1018 or speaker cup unit 1006 or earphone 1000 and then automatically adjusts the sound direction/stereo output effects of speaker unit 1018.

The size, design, shape, method of operation, location and material of the computerized sound controller 1080 may vary.

A front cover/sound output unit 1020 of the speaker cup unit 1006 covers the speaker unit 1018 and delivers the sounds for an On-Ear sound output. The front cover unit 1020 contains the sound flow holes and sound isolation and noise filter made of any suitable soft stretchable material, for example, fabric, leather, soft plastic, rubber or a sponge material. Many layers may be applied onto noise filter unit of front cover unit 1020 for sound isolation and noise filtering. Front cover unit 1020 may contain many small holes to deliver the sounds and filter the noise. The noise filter maximizes blocking out of noise, minimizes ambient sounds, and creates a better stereo field between the closed ear cup unit 1006 and a user's ear.

The noise filter unit of front cover unit 1020 has sufficient elasticity to accommodate the 3D movement and 3D rotation of center speaker unit 1018 and the speaker cup unit 1006.

The unit 1020 and ear speaker cup unit 1006 are preferably covered with a soft material to create a soft and warm touch when in contact with a wearer's ears as a closed ear cup. Ear cup unit 1006 and unit 1020 are preferably provided with high quality materials for excellent wearing comfort.

Unit 1020 and ear cup unit 1006 may be designed in an earphone style designed to cover the entire ear, in a partial ear-covering earphone style, or in an ear tunnel covered ear snug style.

A high speech clarity and voice recognition can be achieved by adjusting the sound stereo angle of adjustable speaker unit 1018 and sound stereo cover and filter unit 1020 for reducing sound reflection and mix in a user's ear.

The design, size, location, function, shape, and material of the unit 1020 may vary.

The 3D stereo ear speaker system 1000 and all related units shown in the various embodiments of FIGS. 1-19 may also be used in any headset, headphone, ear-snug set, or hearing aid device.

Figure 8:
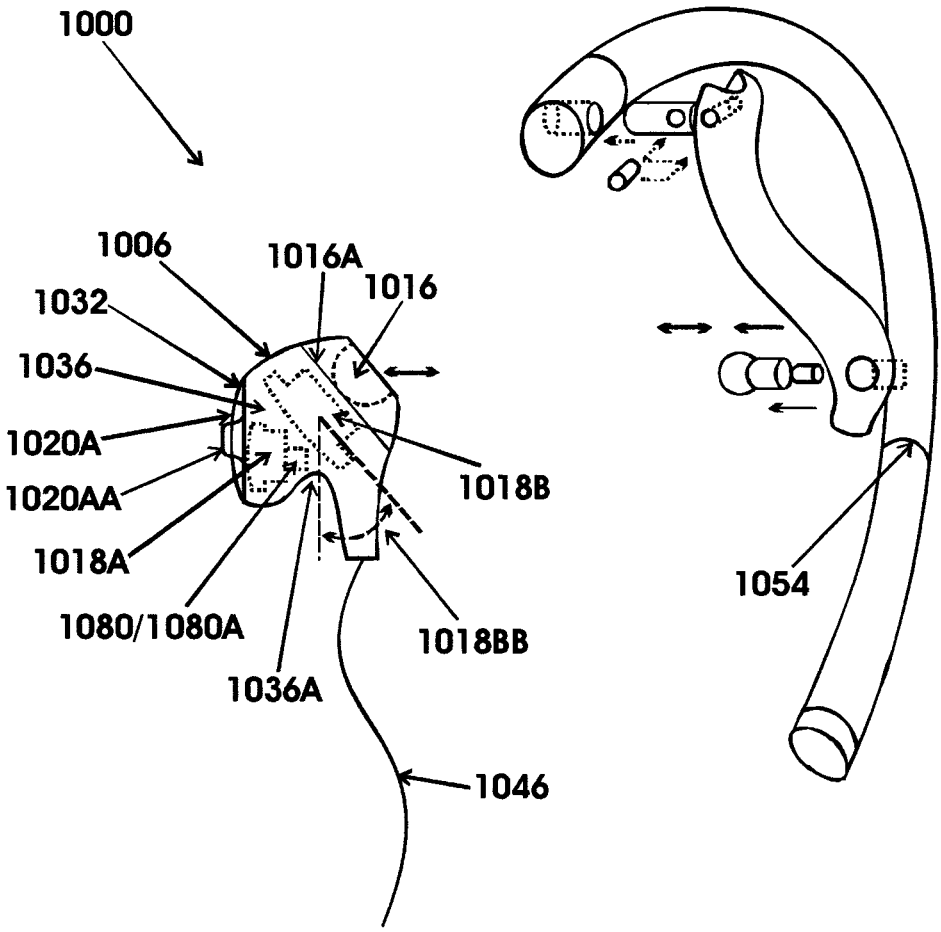
FIG. 8 is a side view of another embodiment of one earphone in accordance with the invention.

FIG. 8 shows one embodiment of earphone with the center speaker unit 1018 containing two speakers 1018A and 1018B oriented at angles with respect to each other in an angle direction structure 1018BB and with focus-ear sound output unit 1020A/AA. One speaker 1018A is located at the front of the speaker to handle high frequency of sound. Another speaker 1018B is located at the back of the cup to handle bass/middle frequencies of sound. The sound unit 1080A directs the high sound into the first speaker 1018A and directs the bass/middle frequencies of sounds into the second speaker 1018B in order to achieve and best balance the 3D stereo sound effects. The back speaker 1018B can be arranged with the angled position 1018BB. The angle direction or position can be adjustable to achieve the best sound delivery. The speakers in this angled position 1018BB work with the sound resonant area 1036 to create sound resonance and harmony. As the angle degree of angle position 1018BB is larger, preferably at an angle of twenty-five degrees, the sound bass resonance and harmony of the speaker unit 1018 will be stronger in a Z-axis deep sense.

Figure 9:
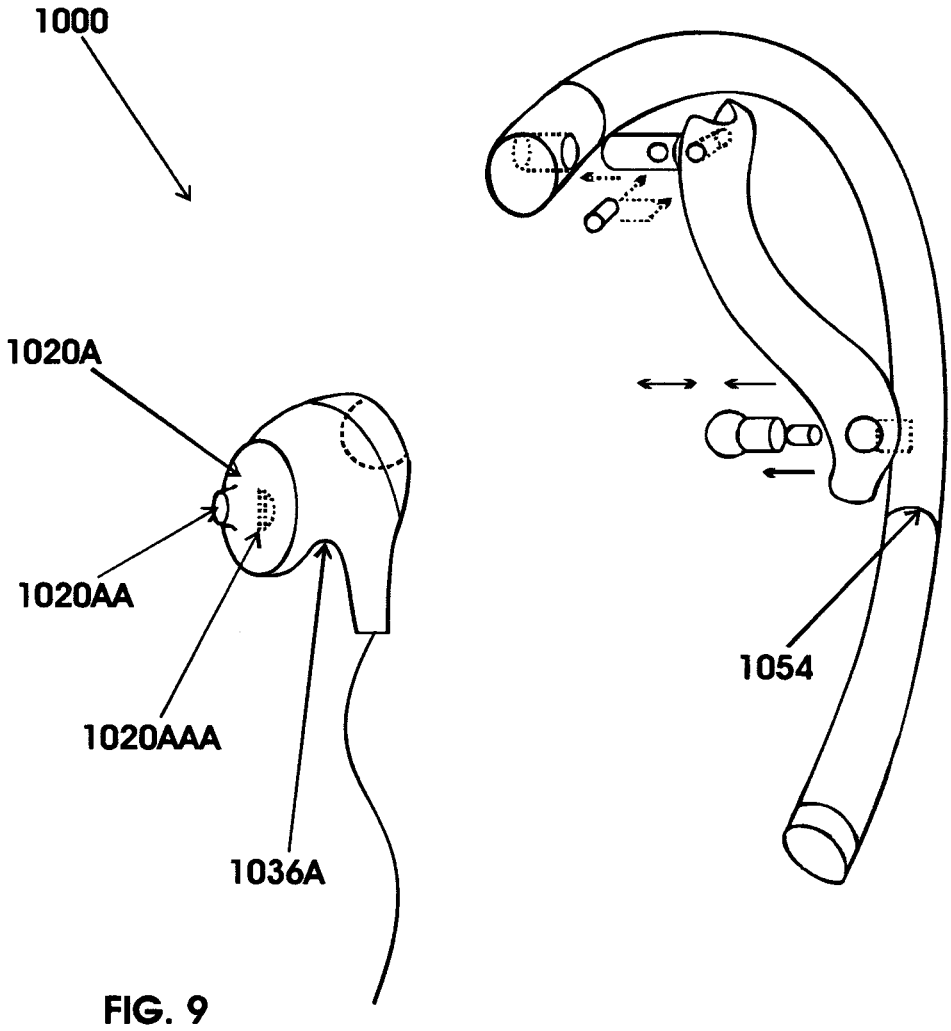
FIG. 9 is a side view of the embodiment of FIG. 8.

The focus-ear sound output units 1020A, 1020AA, and 1020AAA, shown more clearly in FIG. 9, may have a duck mouth style, an open speaker style, a speaker tunnel style, a straight style, or a curved style for 3D stereo sound output into a user's ear with clear stereo sounds and for comfortable wearing.

The design, size, location, function, shape, and material of the focus-ear sound output units 1020A, 1020AA, and 1020AAA may vary.

The method of operation, size, design, shape, location, material and style of two speaker units 1018A and 1018B, the angle function 1018BB, the sound resonator 1036, the special structure 1036A, and the front cover unit 1020 containing the units 1020A, 1020AA and 1020AAA may vary.

Figure 10:
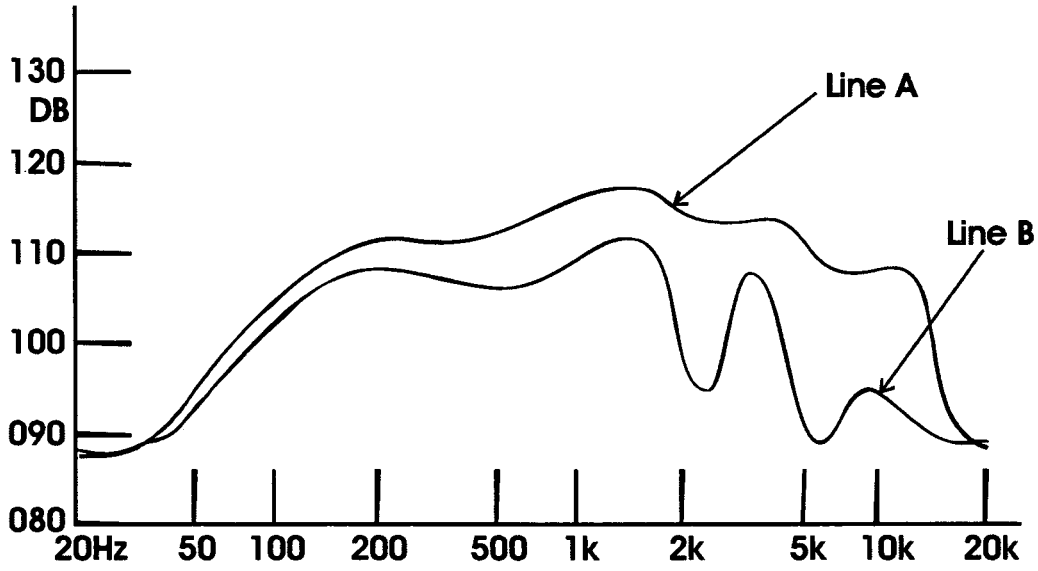
FIG. 10 is a chart of sound stereo wave/level frequency wave lines in association with the embodiment shown in FIG. 8.

FIG. 10 shows the sound results of the embodiment shown in FIG. 8. When an earphone according to the embodiment in FIG. 8 has an angle 1018BB inside the area of sound resonator 1036 of twenty-five degrees, the combined bass sound of speaker drivers 1018A and 1018B will be at line A. When the angle 1018BB is forty-five degrees, the combined bass sound of speaker drivers 1018A and 1018B will be at line B. In that case, the angle 1018BB is bigger and the bass sound output is stronger, especially for Z-axis depth.

The curved structure 1036A should be related to the inside effect of stereo sound output quality and to the outside effect of wearing comfort of the earphone 1000.

A front cover unit 1020 of the speaker cup unit 1006 covers the speaker unit 1018 and delivers the sounds as output sounds. The front cover unit 1020 contains the sound flow unit 1020A. The sound flow unit 1020A has one big output mouth 1020AA and several small holes 1020AAA. Those units focus an Onto-Ear sound output. The output mouth 1020AA is designed to deliver and focus sounds, mostly the bass sound. The small hole unit 1020AAA is designed to deliver and focus middle and high frequency sounds mostly onto the ear tunnel. As the output unit 1020AA is longer, the bass sound will be stronger. If the output unit 1020AAA has more holes, the high and middle sounds will be higher and clearer. Of course, the units 1020AA and 1020AAA can be switched and replace each other or can be switched with any other kind of sound output method.

Figure 11:
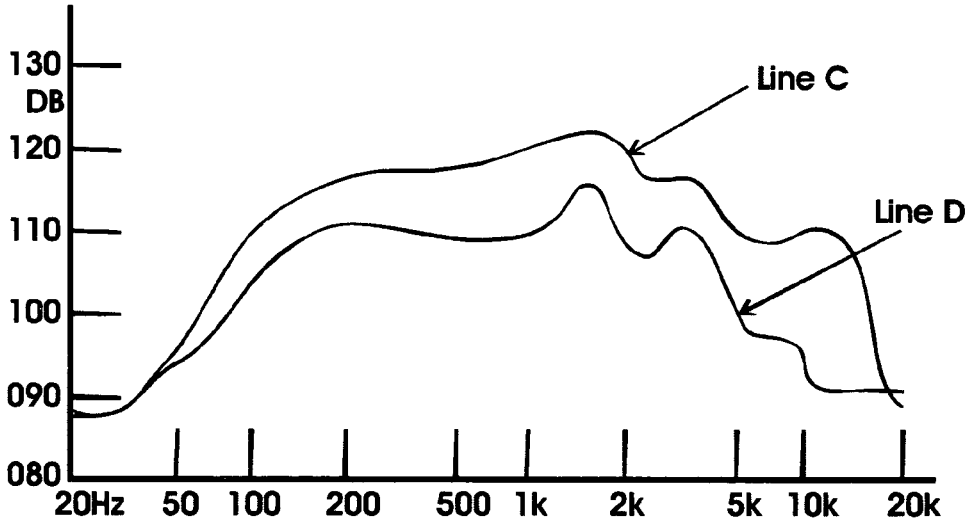
FIG. 11 is another chart of sound stereo wave/level frequency wave lines in association with the embodiment shown in FIG. 9.

FIG. 11 shows sound results from an example of the style of earphone shown in FIG. 9. When the small hole unit 1020AAA of the style of earphone shown in FIGS. 8 and 9 has 6-10 small holes with an approximately 0.5 mm diameter for each hole, the sound output of combined speaker drivers 1018A and 1018B is at line B. When the output unit 1020AA is with no hole unit 1020AAA, the sound output of combined speaker drivers 1018A and 1018B will be at line C. In that case, with fewer or smaller holes 1020AAA, the bass sound will be much stronger. If the earphone has more or bigger holes 1020AAA, the sound output will be much clearer at high/middle frequency ranges.

The output unit 1020A with an Onto-Ear style is removable and replaceable for different unit sizes for different human ears, and is exchangeable with other cover/output designs, such as the On-Ear style unit 1020 in the embodiment shown in FIG. 7, and the In-Ear style unit 1020B in the embodiments shown in FIGS. 1 to 6.

Figure 12:
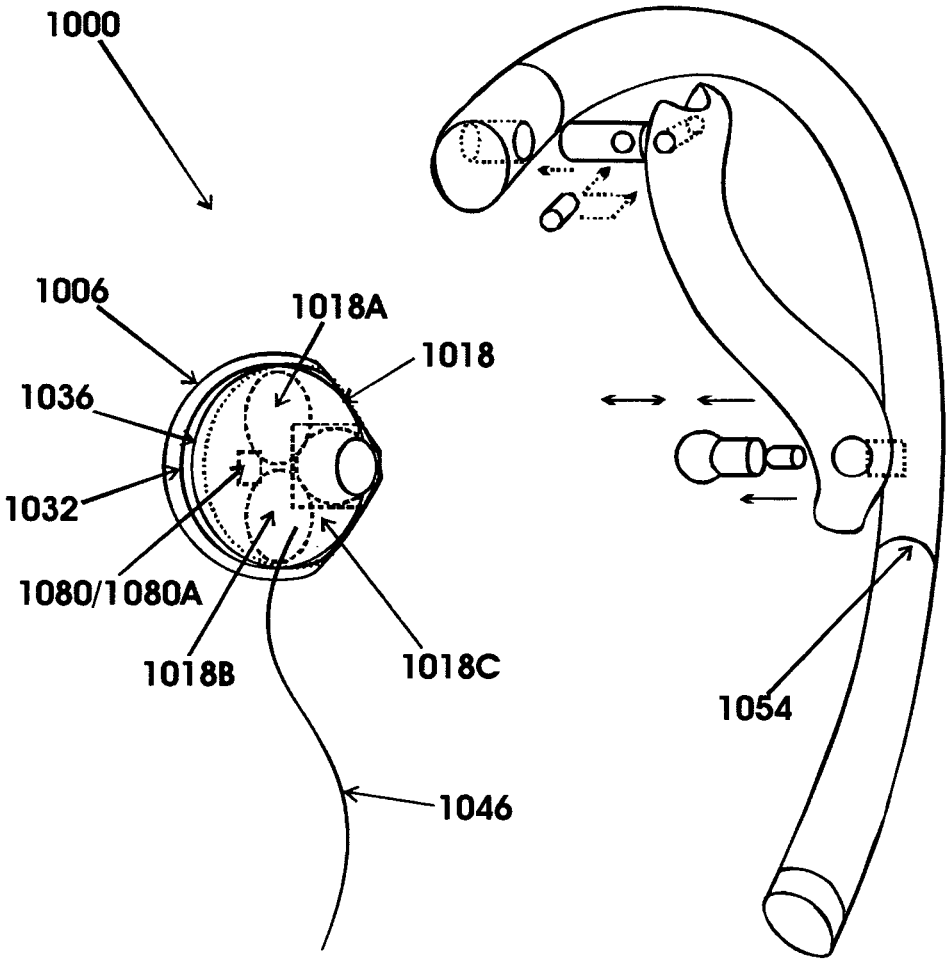
FIG. 12 is a back view of another embodiment of one earphone in accordance with the invention with a rear view of a portion of the earphone.
Figure 12A:
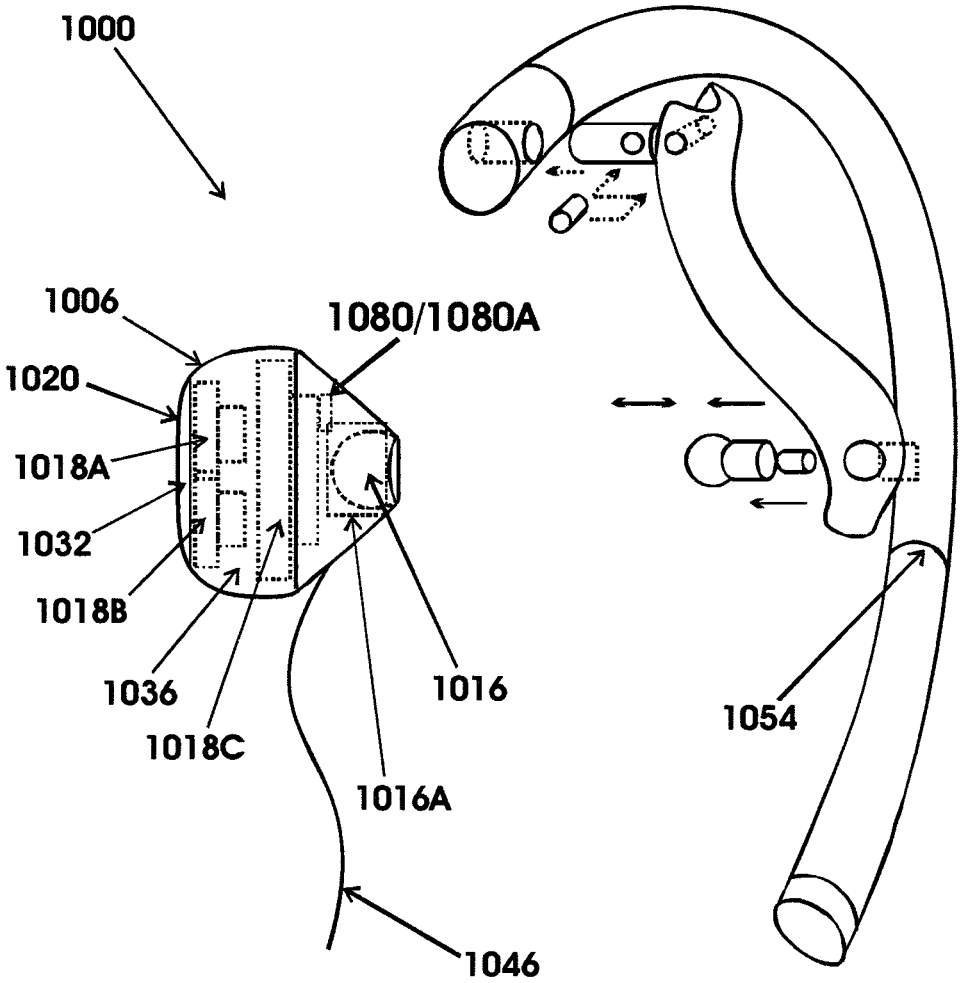
FIG. 12A is a side view of the embodiment shown in FIG. 12.

FIGS. 12 and 12A show another embodiment of the speaker unit 1018 containing three speakers 1018A, 1018B, and 1018C and sound controller 1080. Preferably, one speaker 1018A is a sound driver handling high frequency mostly. Another speaker 1018B handles bass frequency of sound mostly. The third speaker 1018C handles middle frequency range of sound mostly. Those three speakers work together to deliver stereo sounds matching the detailed original stereo digital sound tracks.

Sound controller 1080 containing sound unit 1080A receives all sound signals from the original sound tracks and then analyzes and directs those original sound tracks into different sound channels for those three speakers 1018A, 1018B, and 1018C. Sound unit 1080A may have a capacitor unit containing one or more capacitors and related wires or other related electric units.

Inside speaker cup unit 1006 are a sound check member or piece 1032 and other sound check members or pieces to create a sound resonance area 1036 within ear cup unit 1006.

The arrangement, size, design, shape, material, method, location, and combination of the units 1018A, 1018B, and 1018C may vary if needed to apply to the various embodiments shown in FIGS. 1 to 19.

Figure 13:
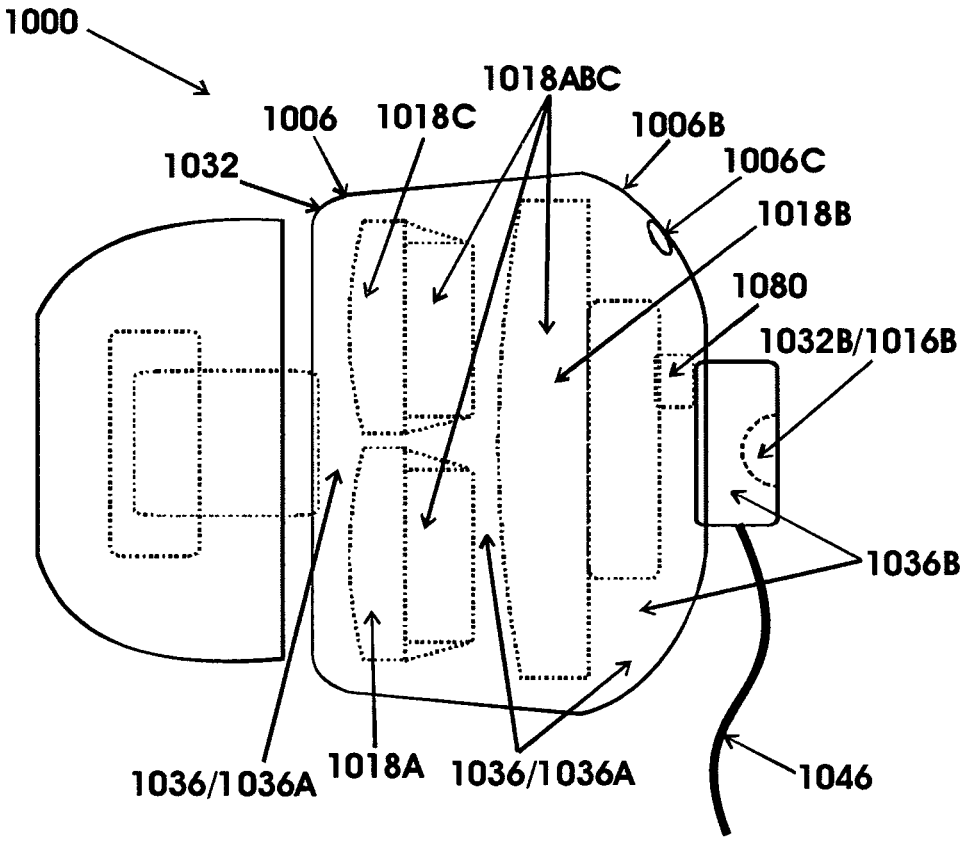
FIG. 13 is an enlarged top view of a variant of the embodiment of FIG. 12.

FIG. 13 shows in greater detail an embodiment of the style of earphone shown in FIG. 12 and FIG. 12A in In-Ear Earphone structure with different arrangement of the triple sound drivers. This embodiment includes the triple sound drivers unit of speakers 1018A, 1018B, and 10180 and sound controller 1080 which are shown in a top view of earphone 1000. There are three speakers (sound drivers) 1018A, 1018B, and 1018C inside the ear cup 1006. In order to form the front and back straight array unit with three speakers (triple sound drivers), two speakers 1018A and 1018C are located at the front of the ear cup 1006 with one to handle high frequency and another speaker to handle middle frequency of sound separately and independently. Another speaker 1018B is located at the back of the ear cup 1006 to handle bass frequency of sound. In a reversed way, the speakers 1018A and 1018C may instead handle bass and middle sounds independently and the other speaker 1018B may handle a high frequency of sound. In a third alternative, the speakers 1018A and 1018C may both handle high sound only and the speaker 1018B may handle bass and middle frequencies of sound. There are many possible sound frequency combinations of those three speakers in a straight arrangement at the front and the back of the structure.

The position/location and size/shape changes of one, two, or more of speakers 1018A, 1018B, and 1018C working with sound units 1080/1080A and sound effect units 1032 and 1036 can create different 3D stereo sound effects. For example, the speakers 1018A, 1018B, and 1018C can be arranged with two in front and one in back inside the speaker cup unit 1006. It is possible to have two front speakers in small sizes and one back speaker in a large size, or one front speaker in a small size, one front speaker in a medium size, and one back speaker in a large size, or three front speakers all of the same or different small/medium sizes, etc.

The small high definition drivers 1018A and 1018C are directly arranged in the front side and the large high efficiency driver 1018B is straightly arranged in the back side of the small driver 1018A with a specially-designed frequency configuration unit 1080/1080A for very strong sound stereo bass and sympathetic response. Each speaker (sound drivers 1018A, 1018B, and 1018C) handles each level of sound frequency for bass (low), middle and high sounds. Therefore, the triple speakers 1018A, 1018B, and 1018C straightly arranged create a stage-like real sound delivery system in X-Y-Z three dimensional (3D) sound stereo space because the triple speakers 1018A, 1018B, and 1018C explore stereo sounds in X-Y axes senses in a wide horizontal way, plus, at the same time, the large speaker 1018B delivers very strong sounds, preferable bass frequency, from the back to have a Z-Axis stereo sound in a deep vertical way for X-Y-Z axes 3D stereo surrounding sound effects with bass/mid/high sound frequencies.

Therefore, a listener can hear a strong bass sound from deep back to near front in a powerful sound wave with a Z-axis sense. At the same time, the listener can hear real stereo sounds with X-Y axes in very detailed crystal-clear sound from front, from left, from right, from back, from everywhere the stereo music is destined to play in three dimensions (3D).

The design, function, shape, form, size, structure, location, and material of the triple drivers of this front/back straight array unit of back large speaker 1018B and front small speakers 1018A and 1018C may vary.

Of course, the triple speakers unit works with or as part of all functions and methods and units explained in all the various embodiments shown in FIGS. 1 to 19. The triple speakers unit may contain more than three sound drivers.

Figure 14:
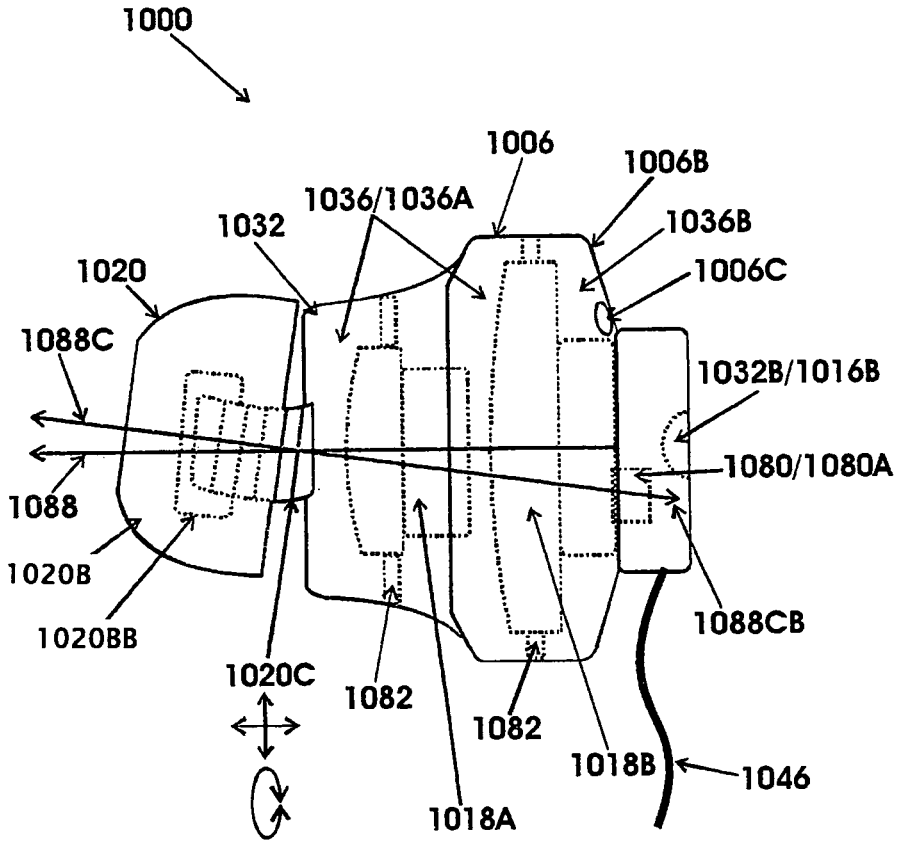
FIG. 14 is an enlarged side view of another embodiment of one earphone in accordance with the invention.

FIG. 14 shows another embodiment of an earphone 1000 that provides a three-dimensionally adjustable 3D stereo sound output direction/effect and that can be worn comfortably. The sound output unit 1020 of this earphone. 1000 has a 3D sound effect and output direction-adjustable unit 1020C that can be adjusted to have an angled axis line 1088C. Direction adjustable unit 1020C works with speakers 1018A and 1018B which share the same center axis line 1088. The direction-adjustable unit 1020C performs three basic functions at the same time to achieve a special sound environment from the sound sources 1018A and 1018B, to the sound effect area 1032 and resonance areas 1036/1036A, and to the output unit 1020 into a user's ear tunnel directly, closely, and adjustably. The first function is to focus the sound effect and deliver the 3D stereo sounds generated from the speaker unit containing two or three multiple drivers 1018A, 1018B, and 10180 into a user's ear tunnel directly and closely. The second function is to work all sound waves and effects. The third function is to provide adjustability in three-dimensional directions X-Y-Z and rotationally over 360 degrees as the arrows indicate. In the third way, the In-Ear sound output unit 1020 is adjustable to provide sound output direction adjustability/changeability and fit in a user's ear tunnel fully, tightly, and more comfortably.

There are some adjustable steps within the adjustable unit 1020C. The adjustable unit 1020C may use any kind of adjustable, bendable, moveable, or stretchable method, structure, and material that provides adjustability, an ability to bend, or an ability to stretch.

Of course, it should be very carefully considered that the sound output adjustable unit 1020C will have an effect on sound delivery when bent or adjusted to create a sound delivery axis changed line 10880 from the 3D stereo sound waves 1018AW and 1018BW of the multiple speakers 1018A and 1018B. The angled axis line 1088C for sound delivery and effect and the sound waves 1018AW and 1018BW all work synchronously together inside the sound output unit 1020C for 3D stereo sound effects/outputs in X-Y-Z 3D stereo sound space with bass/mid/high sound frequencies. Furthermore, the angled axis line 1088C for sound delivery and effect of the sound output and 3D adjustable unit 1020C will extend the axis line 1088CB into the sound effect units 1032 and 1032B/1016B and into the sound resonance units 1036/1036A and 1036B. The axis line 1088CB works with the sound waves 1018AW, 1018BW, 1018ABW, and 1018BBW to create multiple sound effects in X-Y-Z 3D dimensions with bass/mid./high sound frequencies. Therefore, 3D direction adjustable unit 1020C works with multiple sound effects combined sound axis lines 1088C and 1088CB together at the same time. This kind of sound output effect change has a good aspect in that a user can adjust the sound output unit 1020 to achieve the sound 3D stereo effects he or she likes and to achieve wearing comfort also at the same time.

The design, size, location, function, shape, and material of the sound direction adjustable unit 1020C may vary if needed to apply to the various embodiments shown in FIGS. 1 to 19.

Figure 15:
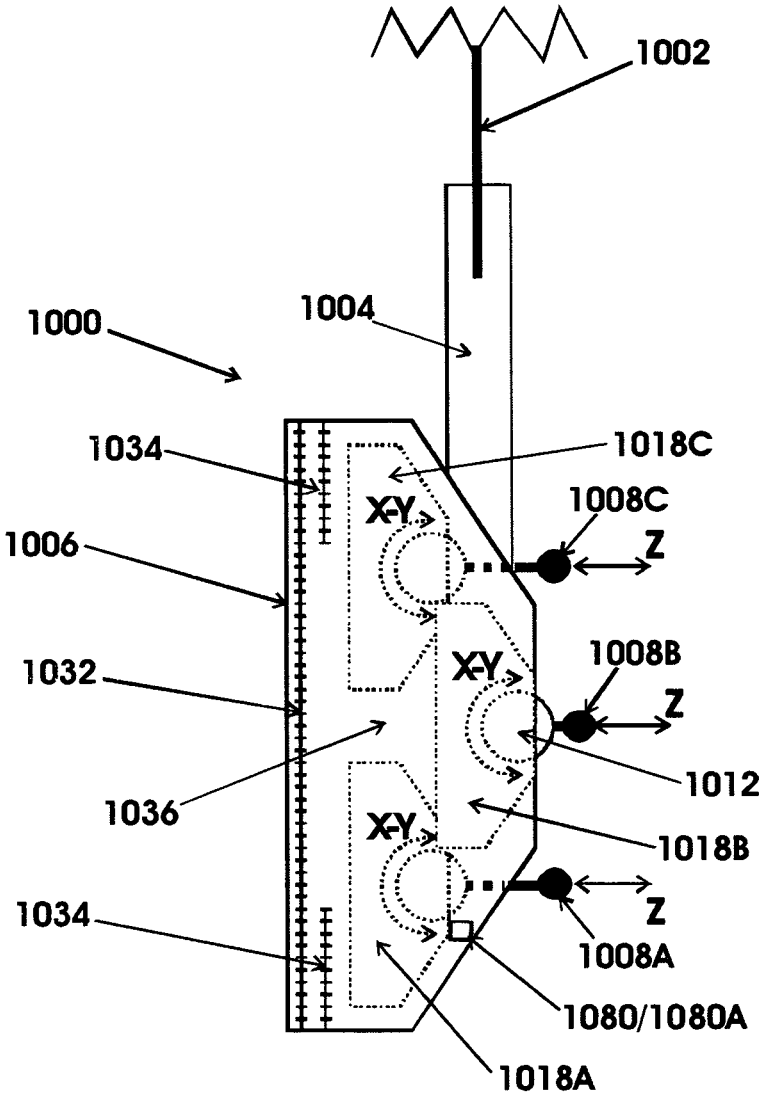
FIG. 15 is a side view of another embodiment of one earphone in accordance with the invention.
Figure 16:
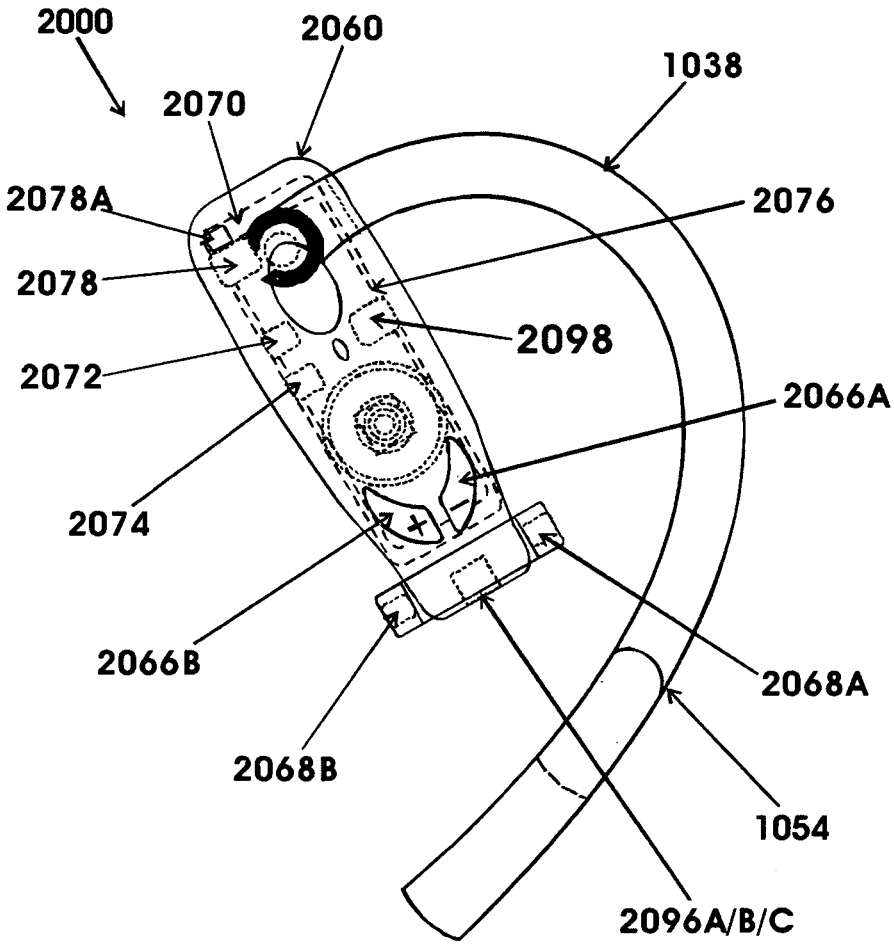
FIG. 16 is a view of another embodiment of one earphone in accordance with the invention.
Figure 17:
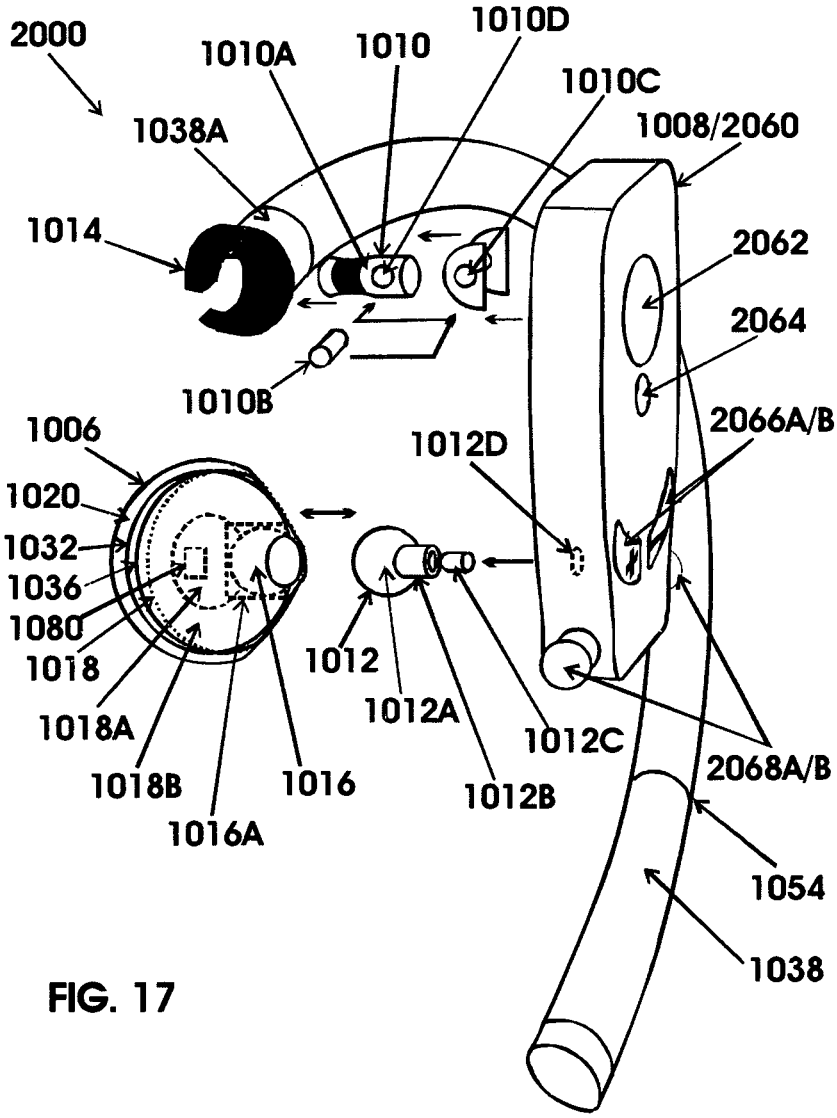
FIG. 17 is a view of a variant of the embodiment of FIG. 16.
Figure 18:
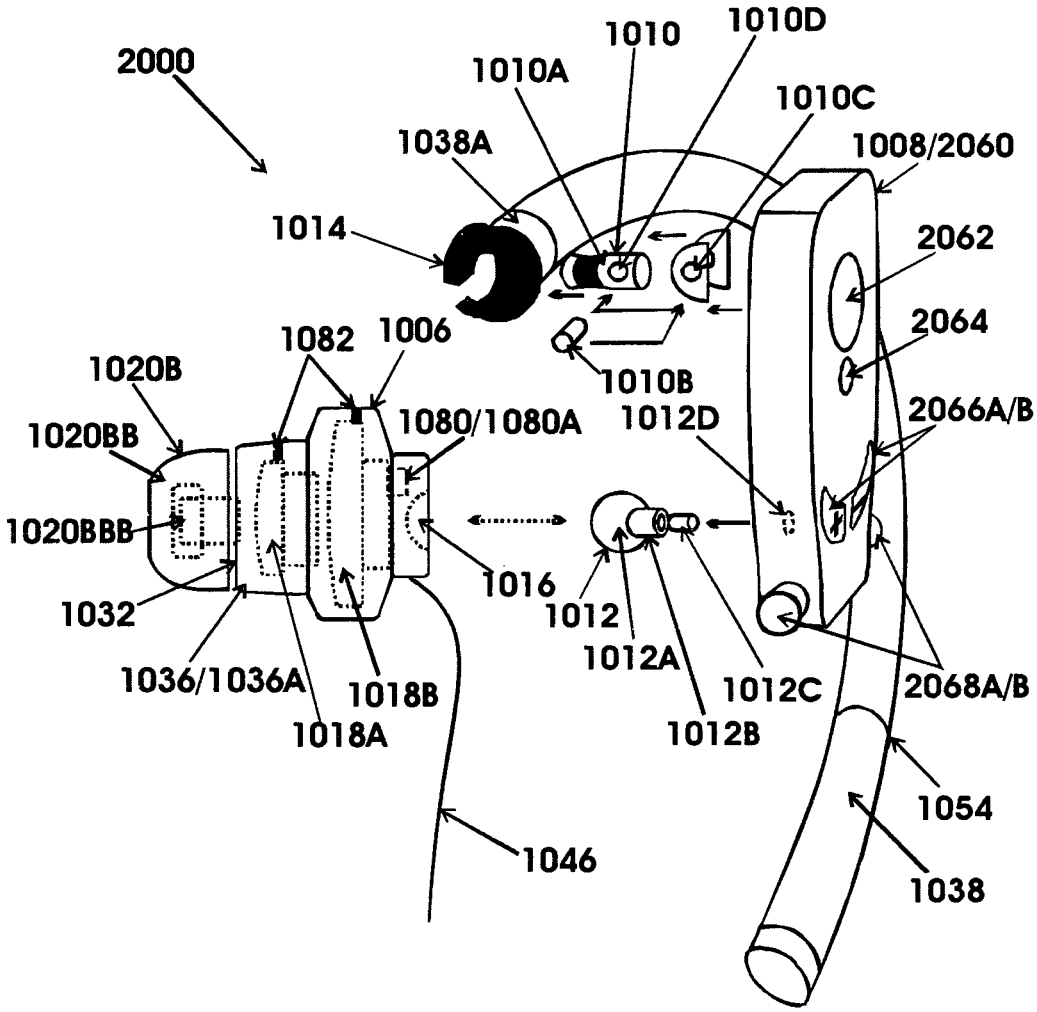
FIG. 18 is a view of the embodiment of FIG. 17 with a side view of a portion of the embodiment.

FIG. 15 shows another embodiment of earphone having multiple speakers for 3D stereo sound effects and having adjustable sound directions of the earphone 1000. In this embodiment, there are three speakers (sound drivers) 1018A, 1018B, and 1018C inside the ear cup 1006. In order to arrange these three speakers (triple sound drivers) in a front and back straight array, two speakers 1018A and 1018C are located at the front of the ear cup 1006 with one speaker to handle high frequency and another speaker to handle middle frequency of sound separately and independently. Another speaker 1018B is located at the back of the ear cup 1006 to handle bass frequency of sound. In a reversed way, the speakers 1018A and 1018C could handle bass and middle sounds independently and the other speaker 1018B could handle high frequency of sound. In a third alternative, the speakers 1018A and 1018C could both handle high sound only and the speaker 1018B could handle bass and middle sound frequencies. There are many possible sound frequency and driver position combinations for those three speakers having a straight arrangement at the front and the back or at a side structure of the ear cup or earphone.

The size arrangement of the speakers 1018A, 1018B, and 1018C is preferably two small sound drivers at the front of the ear cup or earphone and one large sound driver at the back of the ear cup or earphone. They could, however, all have the same size or there could be one large at the front and two small at the back, etc., if needed.

The small high definition drivers 1018A and 1018C are directly arranged in the front side of the earphone and the large high efficiency driver 1018B is straightly arranged in the back side of the small driver 1018A with a specially-designed frequency configuration unit 1080/1080A for very strong sound stereo bass and sympathetic response. Each speaker of sound drivers 1018A, 1018B, and 1018C handles each level of sound frequency for bass (low), middle and high sounds. Therefore, the triple speakers 1018A, 1018B, and 1018C in a straight arrangement creates a stage-like real sound delivery system in X-Y-Z three-dimensional (3D) sound stereo space because the triple speakers 1018A, 1018B, and 1018C explore stereo sounds in two dimensions (X-Y axes senses) in a wide horizontal way, plus, at the same time, the large speaker 1018B delivers very strong sounds, preferable bass frequency, from the back to have a Z-Axis stereo sound in a deep vertical way for X-Y-Z 3D stereo surrounding sound effects with bass/mid/high sound frequencies.

At the same time, there are speaker direction change units 1008A, 1008B, and 1008C connected to the related speakers 1018A, 1018B, and 1018C, respectively. Those speaker direction change units 1008A, 1008B, and 1008C can separately and independently adjust the positions and directions of speakers 1018A, 1018B, and 1018C, respectively, with turns along the X-Y axes and with pushing in or out for Z-axis movements to achieve the adjustments in X-Y-Z three dimensions synchronously. At the same time, those speaker direction change units 1008A, 1008B, and 1008C can also adjust the 3D stereo sound effects in X-Y-Z 3D stereo sound space. Each speaker 1018A, 1018B, or 1018C has its own respective speaker direction/position change unit 1008A, 1008B, or 10080. There are many synchronous combinations of sound direction adjustments and sound 3D stereo effects that could result from those speakers 1018A, 1018B, and 1018C and their change units 1008A, 1008B, and 1008C working with the sound configuration unit 1080, sound effect units 1032 and 1034, and sound resonator 1036.

Therefore, a listener can hear a strong bass sound from far back and can hear real stereo sounds in the X, Y, and Z axes in very detailed crystal-clear sound from front, from left, from right, and from back in a three dimensional sound space. At the same time, a user can adjust the 3D stereo sound direction and space for the 3D sound stereo effects and 3D sound direction changes for comfort, music creation, music playing, listening, and wearing he or she likes.

The speaker direction change units 1008A, 1008B, and 1008C contain their own related male/female joint parts and handlers for movements along each of the X, Y, and Z axes. The design, function, shape, joint form, size, type, structure, location, material, and parts of the speaker direction/position change units 1008A, 1008B, and 1008C may vary. The speaker unit can be just one speaker to multiple speakers if needed. Of course, the speaker direction change units 1008A, 1008B, and 1008C may work with or for all functions, methods, and units and all types of earphones and headphones shown in the various FIGS. 1 to 19. There is an ear band holder unit 1002 and an earcup, adjustable unit 1004.

The earphone 1000 in this embodiment may contain one speaker to multiple speakers and one speaker change unit to multiple speaker change units accordingly.

Generally speaking, for all of the embodiments shown above in FIGS. 1 to 15, the earphone 1000 achieves the three basic considerations of In-Ear earphones: small size, real stereo sound quality with bass/middle/high sound frequencies, and wearing/hearing comfort, and the earphone 1000 meets these three considerations within a very small, closed, and isolated sound space, output environment, and structure.

All units and functions and structures explained above and shown in FIGS. 1 to 19 may be used, applied, or inter-exchanged in any figure of this application for all types of earphones and headphones if needed.

FIGS. 16, 17, 18, and 19 show another embodiment of wireless earphone 2000. The wireless earphone 2000 contains the ear band unit 1038, speaker adjustable hold units 1008, a roller/ball unit 1010, the ball unit 1012, the socket units 1014 and 1016, the speaker cup unit 1006, the speaker units 1018A and 1018B (and may also have a third speaker 1018C), the sound controller 1080/1080A, the sound effect unit 1032, the sound resonator 1036/1036A, and the speaker output units 1020 and 1020B, 1020BB, and 1020BBB. Those units are all similar to the units showed and discussed in all previous figures from 1 to 15.

The wireless earphone 2000 also contains a wireless carrier unit 2060. This carrier unit 2060 is similar to an extension or enlargement of the speaker adjustable holder unit 1008. There may be a male unit 1010 for adjustability in the X, Y, and Z axes attached to the carrier unit 2060 to work adjustably with the ear holder unit 1038 through a hole or socket female unit 1014. The unit 1014 may be designed as a big C style. At the same time, there is an X-Y-Z 3D rotatable male unit 1012 attached to the carrier unit 2060 to work adjustably with the speaker cup unit 1006 through a socket/female unit 1016.

The carrier unit 2060 may contain a switch unit 2062, a light indicator unit 2064, voice control units 2066A and 2066B, microphone units 2068A and 2068B. The switch unit 2062 may have many functions, such as allowing the wireless carrier unit 2060 to be turned on and off, controlling the wireless connection to a cell phone, switching between music and talk, controlling voice function, and controlling many additional cell phone functions. The light indicator unit 2064 shows the wireless connection status, power level indication, power recharge indication, on-and-off indications, and talk-and-music indication. The voice control unit 2066A may add to the voice volume and unit 2066B may reduce the voice volume. The location, design, and function of the units 2066A and 2066B may be switched with each other. The control units 2066A and 2066B may be used to control the contents, such as songs, for forward or backward playing or for jumping to the beginning or ending function also. The microphone units 2068A and 2068B allow a cellular phone talk function. The microphone units 2068A and 2068B may have background noise reduction and filter functions in order to produce a clear talking effect.

A mother board 2070 may be inside the carrier 2060. There may also be a CPU unit 2072, a memory unit 2074, a battery unit 2076, a wireless unit 2078, and a USB connector unit

2096 inside the carrier unit 2060. Additionally, there may be a Multiple Player Unit 2098 inside the carrier unit 2060.

The size, design, shape, material, location, function, and method of the carrier unit 2060, the switch unit 2062, the indicator unit 2064, the voice control units 2066A and 2066B, the microphone units 2068A and 2068B, the mother board unit 2070, the CPU unit 2072, the memory unit 2074, the battery unit 2076, the wireless unit 2078, the antenna unit 2078A, the USB connector unit 2096, and the MP unit 2098 may vary if necessary. The microphone units 2068A and 2068B may be exchangeable, may be adjustable in angle or length, may be removable, and may be extendable. The wireless unit 2078 may contain an antenna unit 2078A and may work with Bluetooth, Wi-Fi, 2.4G, 3G, 4G, or any other kind of wireless communication system or method.

The wireless earphone 2000 may have all or some of the units of embodiments shown in FIGS. 1 to 15 if needed, for example, the speaker cup unit 1006 containing one, two, or three speaker drivers 1018A, 1018B, and 1018C for X-Y-Z axes 3D stereo sound effects with bass/mid/high sound frequencies. At the same time, the wireless earphone 2000 may have the output unit 1020 containing On-Ear unit 1020, Onto-Ear units 1020A, 1020AA, and 1020AAA, or In-Ear units 1020B, 1020BB, and 1020BBB.

The roller unit 1010 contains a male roller 1010A to work with the female hole 1014 in order to achieve an X-axis rotation of the speaker holder unit 1008. There is a screw 1010B to go through a hole 1010C of the speaker holder unit 1008 and go through a hole 1010D of the male roller 1010A to achieve Z and Y axis rotations of the speaker holder unit 1008. So, the roller unit 1010 actually achieves X-axis rotation, Y-axis rotation, and Z-axis rotation of the speaker holder unit 1008 at the same time.

The ball/male unit 1012 contains a ball 1012A and ball stick 1012B and a screw 1012C. The ball stick 1012B is to hold the ball 1012A. The screw 1012C is to go through a hole 1012D of the speaker holder unit 1008 to screw into the stick 1012B in order to hold the ball 1012A with the speaker holder unit 1008 together. The ball 1012A is to work with the ball socket/female unit 1016 of the speaker cup unit 1006 to achieve 3D rotatable function of the speaker cup unit 1006 containing the center speaker unit 1018.

The socket unit 1016 contains a ball-movement friction control unit 1016A to achieve the movement smooth and stable of the ball 1012A.

Figure 19:
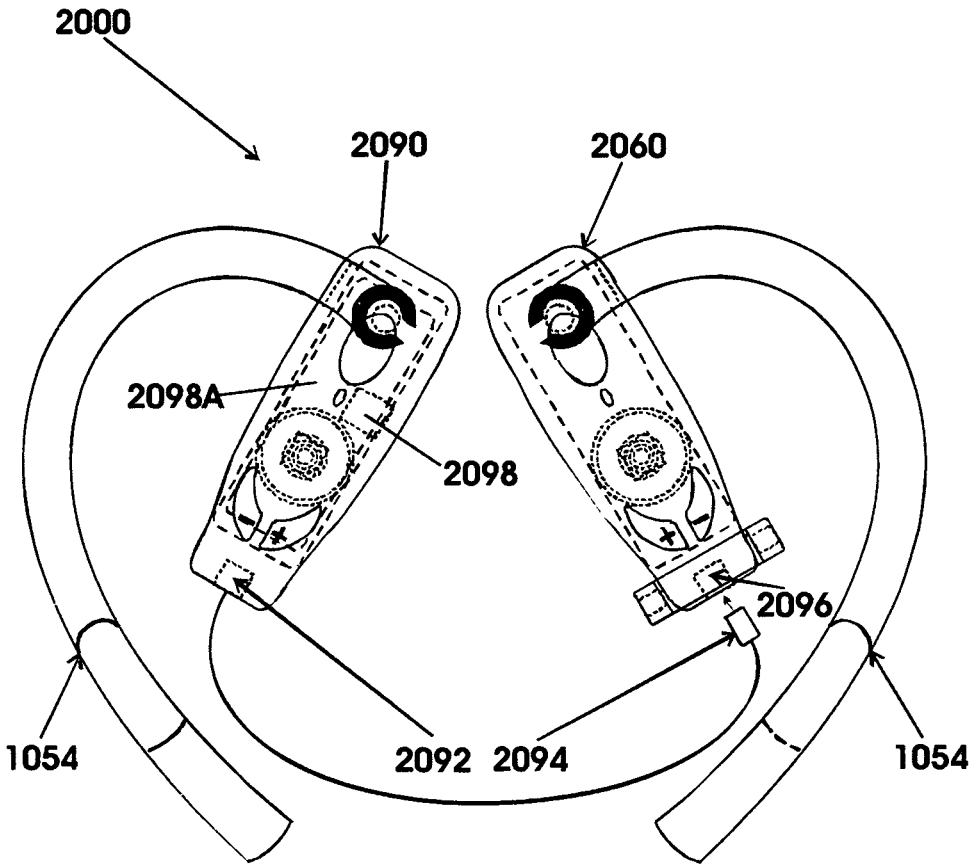
FIG. 19 is a perspective view of an embodiment having a pair of wireless earphones working and connected to each other in accordance with the invention.

FIG. 19 shows the wireless earphone as a set of units 2060 and 2090. The unit 2060 is a main unit containing all wireless parts. The unit 2090 is a carrier with an ear cup unit 1006 of the same type as the one in the carrier 2060. The unit 2090 has a connector 2092. There is a USB wire/connector unit 2094 to connect the connector unit 2092 of the unit 2090 to the connector unit 2096 of the carrier unit 2060. Therefore, the whole set of the wireless earphone can be used for a pair of a user's ears for 3D adjustable stereo sound.

The USE wire connector units 2096 and 2092 may be used as a USB communication unit, as a battery recharger unit, or as a memory/multiple player unit.

There may be a multiple player unit 2098 and/or battery unit 2098A inside the carrier unit 2090 which perform or performs additional play and/or energy functions. In that case, the carrier unit 2090 may have the same inside units as the carrier unit 2060.

The carrier units 2060 and 2090 may be switched with each other for left or right ear users. The carrier unit 2060 may be separable and independent from the ear band unit 1038 through the roller/ball unit 1010 and hole or big C-style socket unit 1014, or in other words, may be assembled or unassembled in this manner by the user. The roller/ball unit 1010 and the socket unit 1014 have some identical structures or steps to achieve separability and independence of functions or assembled or unassembled methods.

The carrier unit 2090 has the same separable and independent structure and function as the carrier unit 2060. Therefore, a user can switch the carrier unit 2060 with the carrier 2090 easily and conveniently for left or right ear cell phone talking.

The carrier unit 2060 can be used as a single unit for cell phone talking with no connection to the carrier unit 2090. The carrier unit 2090 may also be used as a multiple player unit to work with the carrier unit 2060 or without the carrier unit 2060.

The size, design, shape, material, location, function, and method of the carrier unit 2060, the carrier unit 2090, the connector unit 2092, the wire/USB connector unit 2094, and the USB connector 2096, and the multiple player unit 2098 may vary if necessary.

All units and functions and structures explained above and shown in FIGS. 1 to 19 may be used, applied, or inter-exchanged in any of the embodiments shown or described in this application.

The invention claimed is:

1. An earphone producing a three-dimensional stereo sound effect, the earphone comprising:

(a) an ear cup configured to fit within ear cartilage of an ear of a user and comprising a front portion, a back portion, a front sound effect unit disposed in said front portion, a front sound resonator disposed in said front portion, a back sound resonator disposed in said back portion, and a back sound effect unit disposed in said back portion;

(b) at least one front speaker disposed in said front portion of said ear cup;

(c) at least one back speaker disposed in said back portion of said ear cup;

(d) a sound controller disposed in said ear cup; and (e) a sound output unit connected with said ear cup;

wherein sound waves from said at least one front speaker and from said at least one back speaker are mixed within said earphone before being delivered into the ear of the user;

wherein said at least one front speaker and said at least one back speaker work together to create stereo sound in a first dimension and in a second dimension; and wherein one of said at least one front speaker and said at least one back speaker creates stereo sound in a third dimension.

2. The earphone according to claim 1, further comprising:

a back joint unit disposed on said ear cup;

an adjustable holder unit connected with said back joint unit in a detachable manner; and an adjustable ear band unit connected to said adjustable holder unit;

wherein said back joint unit and said back sound effect unit are formed together in one piece.

3. The earphone according to claim 1, further comprising a sound balance hole unit disposed in said ear cup.

4. The earphone according to claim 1, wherein a first center axis line of said at least one front speaker is parallel with a second center axis line of said at least one back speaker.

5. The earphone according to claim 4, wherein said at least one front speaker and said at least one back speaker are each arranged perpendicular to a horizontal axis of said ear cup.

6. The earphone according to claim 1, wherein said at least one front speaker and said at least one back speaker are oriented at an angle with respect to each other.

7. The earphone according to claim 6, wherein one of said at least one front speaker and said at least one back speaker is disposed perpendicular to a horizontal axis of said ear cup.

8. The earphone according to claim 1, wherein said at least one front speaker and said at least one back speaker share a center axis line.

9. The earphone according to claim 1, wherein said at least one front speaker has a first size and said at least one back speaker has a second size, said first size being greater than said second size.

10. The earphone according to claim 1, wherein said at least one front speaker has a first size and said at least one back speaker has a second size, said second size being greater than said first size.

11. The earphone according to claim 1, wherein said at least one front speaker has a first size and said at least one back speaker has a second size, said second size being equal to said first size.

12. The earphone according to claim 1, wherein said front sound effect unit comprises an outside sound effect unit and an inside sound effect unit separate from said outside sound effect unit.

13. The earphone according to claim 1, wherein said front sound effect unit comprises a front wall of said ear cup.

14. The earphone according to claim 1, wherein said front sound resonator comprises a side wall of said ear cup.

15. The earphone according to claim 14, wherein said front sound resonator has a curved shape for fitting onto a bowl-shaped ear of a user of said earphone.

16. The earphone according to claim 1, wherein said at least one front speaker comprises a first front speaker and a second front speaker.

17. The earphone according to claim 1, wherein said at least one back speaker comprises a first back speaker and a second back speaker.

18. The earphone according to claim 1, further comprising a wireless carrier unit, the wireless carrier unit comprising:

a circuit board, a wireless communication chip, a switch unit, a light indicator unit, at least one voice control unit, and a microphone unit.

19. The earphone according to claim 18, wherein said wireless carrier unit further comprises a CPU unit, a memory unit, a battery unit, a USB connector unit, and a Multiple Player Unit.

20. An in-ear earphone producing a three-dimensional stereo sound effect, the in-ear earphone comprising:

(a) an ear cup configured to fit within ear cartilage of an ear of a user and comprising a front portion, a back portion, a front sound effect unit disposed in said front portion, a front sound resonator disposed in said front portion, a back sound resonator disposed in said back portion, and a back sound effect unit disposed in said back portion;

(b) at least one front speaker disposed in said front portion of said ear cup, said at least one front speaker having a first center axis line;

(c) at least one back speaker disposed in said back portion of said ear cup, said at least one back speaker having a second center axis line;

(d) a sound controller disposed in said ear cup;

(e) a front sound output unit configured to fit in an ear tunnel of the ear of the user; and (f) a first 3D direction adjustable unit connecting in a three-dimensional adjustable manner said front sound output unit with said front sound effect unit of said ear cup, so that said front sound output unit can be oriented at an angle to said first center axis line and to said second center axis line;

wherein sound waves from said at least one front speaker and from said at least one back speaker are mixed within said in-ear earphone before being delivered into the ear of the user;

wherein said at least one front speaker and said at least one back speaker work together to create stereo sound in a first dimension and in a second dimension; and wherein one of said at least one front speaker and said at least one back speaker creates stereo sound in a third dimension.

21. The in-ear earphone according to claim 20, wherein said first center axis line and said second center axis line are co-extensive.

22. An earphone producing a three-dimensional stereo sound effect, the earphone comprising:

(a) an ear cup configured to fit within ear cartilage of an ear of a user and comprising a front portion, a back portion, a front sound effect unit disposed in said front portion, a front sound resonator disposed in said front portion, a back sound resonator disposed in said back portion, and a back sound effect unit disposed in said back portion;

(b) at least one front speaker disposed in said front portion of said ear cup;

(c) at least one back speaker disposed in said back portion of said ear cup;

(d) a sound controller disposed in said ear cup;

(e) a sound output unit connected with said ear cup; and (f) at least one speaker direction change unit connected with at least one of said at least one front speaker and said at least one back speaker;

wherein sound waves from said at least one front speaker and from said at least one back speaker are mixed within said earphone before being delivered into the ear of the user;

wherein said at least one front speaker and said at least one back speaker work together to create stereo sound in a first dimension and in a second dimension; and wherein one of said at least one front speaker and said at least one back speaker creates stereo sound in a third dimension.

23. The earphone according to claim 22, wherein said at least one front speaker comprises a first front speaker and a second front speaker; and wherein said at least one speaker direction change unit comprises a first speaker direction change unit connected to said first front speaker, a second speaker direction change unit connected to said second front speaker, and a third speaker direction change unit connected to said at least one back speaker.

24. An earphone system producing a three-dimensional stereo sound effect, the earphone system comprising:

(a) an earphone comprising:

an ear cup configured to fit within ear cartilage of an ear of a user and comprising a front portion, a back portion, a front sound effect unit disposed in said front portion, a front sound resonator disposed in said front portion, a back sound resonator disposed in said back portion, and a back sound effect unit disposed in said back portion;

at least one front speaker disposed in said front portion of said ear cup;

at least one back speaker disposed in said back portion of said ear cup;

a sound controller disposed in said ear cup; and a sound output unit connected with said ear cup;

(b) a wireless carrier unit, the wireless carrier unit comprising a circuit board, a wireless communication chip, a switch unit, a light indicator unit, at least one voice control unit, a microphone unit, a CPU unit, a memory unit, a battery unit, a USB connector unit, and a Multiple Player Unit;

(c) a first back joint unit disposed on said ear cup, said first back joint unit comprising a female unit;

(d) a second joint unit disposed on said wireless carrier unit, said second joint unit comprising a male unit and being connected to said first back joint unit to link said ear cup with said wireless carrier unit in a three-dimensional adjustable manner;

(e) a third joint unit disposed on said wireless carrier unit, said third joint unit comprising a male unit;

(f) an ear holder unit; and (g) an ear holder joint unit disposed on a bottom of said ear holder unit, said ear holder joint unit comprising a female unit and being connected to said third joint unit to link said wireless carrier unit with said ear holder unit in three-dimensional adjustable manner;

wherein sound waves from said at least one front speaker and from said at least one back speaker are mixed within said earphone before being delivered into the ear of the user;

wherein said at least one front speaker and said at least one back speaker work together to create stereo sound in a first dimension and in a second dimension; and wherein one of said at least one front speaker and said at least one back speaker creates stereo sound in a third dimension.

* * * * *